US009868015B2

(12) United States Patent
Bowles

(10) Patent No.: US 9,868,015 B2
(45) Date of Patent: Jan. 16, 2018

(54) EXERCISE DEVICE WITH ROTATABLE REELS

(71) Applicant: Robert Gary Bowles, Stamford (GB)

(72) Inventor: Robert Gary Bowles, Stamford (GB)

( * ) Notice: Subject to any disclaimer, the term of this patent is extended or adjusted under 35 U.S.C. 154(b) by 9 days.

(21) Appl. No.: 14/908,533

(22) PCT Filed: Aug. 6, 2014

(86) PCT No.: PCT/GB2014/052404
§ 371 (c)(1),
(2) Date: Jan. 28, 2016

(87) PCT Pub. No.: WO2015/022499
PCT Pub. Date: Feb. 19, 2015

(65) Prior Publication Data

US 2016/0158590 A1 Jun. 9, 2016

(30) Foreign Application Priority Data

Aug. 11, 2013 (GB) ..... 1314362.3

(51) Int. Cl.
*A63B 21/06* (2006.01)
*A63B 21/068* (2006.01)
(Continued)

(52) U.S. Cl.
CPC ..... *A63B 21/068* (2013.01); *A63B 7/00* (2013.01); *A63B 21/00069* (2013.01);
(Continued)

(58) Field of Classification Search
CPC ..... A63B 21/153; A63B 21/15; A63B 21/151; A63B 21/156; A63B 21/157;
(Continued)

(56) References Cited

U.S. PATENT DOCUMENTS 1,416,741 A * 5/1922 Nicholls ..... A63B 21/04 482/127
4,094,475 A * 6/1978 Takada ..... B60R 22/40 242/382.5
(Continued)

FOREIGN PATENT DOCUMENTS

CN 203370231 U 1/2014
EP 1629867 B1 12/2007
(Continued)

*Primary Examiner* — Nyca T Nguyen

(57) ABSTRACT

An exercise device has a pair of axially spaced reels 102*a*, 102*b*, which are each biased by a spiral spring 108. Each reel is attached to one end of a respective strap 130*a*, 130*b* and an outer end of each strap is attached to a carabiner 134*a*, 34*b*. Each reel is selectably releaseable by a locking arrangement 112*a*, 112*b*, 16, 117, that is able to interfere with rotation of the reels 102*a*, 102*b*, in dependence upon action by a user. Each reel is independently rotatable and each strap 130*a*, 130*b* may be extended or retracted independently of one another. Using the carabiners 134*a*, 134*b*, each strap may be secured to an attachment 10 beam so that the straps form a V-configuration and it is envisaged that two such exercise devices may be used so that a user may perform exercises such as push-ups, triceps dips, back pulls and pull-ups. Non-suspended exercises may be performed by providing rubber feet 127*a*, 127*b*, and two such exercise devices may be connected together by interconnecting male 123*a* and female connectors 124*b*.

22 Claims, 27 Drawing Sheets

(51) Int. Cl.

| | |
|---|---|
| ***A63B 21/015*** | (2006.01) |
| ***A63B 21/072*** | (2006.01) |
| ***A63B 21/00*** | (2006.01) |
| ***A63B 7/00*** | (2006.01) |
| ***A63B 23/035*** | (2006.01) |
| *A63B 23/12* | (2006.01) |

(52) U.S. Cl.
CPC ..... *A63B 21/00185* (2013.01); *A63B 21/072* (2013.01); *A63B 21/0726* (2013.01); *A63B 21/153* (2013.01); *A63B 21/4015* (2015.10); *A63B 21/4034* (2015.10); *A63B 21/4035* (2015.10); *A63B 23/0355* (2013.01); *A63B 23/1218* (2013.01); *A63B 23/1236* (2013.01); *A63B 2225/09* (2013.01)

(58) Field of Classification Search
CPC ..... A63B 21/072; A63B 21/0726; A63B 21/4035; A63B 21/4033; A63B 21/4027; A63B 21/00058; A63B 7/00; A62B 35/0093
See application file for complete search history.

(56) References Cited

U.S. PATENT DOCUMENTS 4,307,853 A * 12/1981 Higbee ..... B60R 22/44 242/385.2
4,470,556 A * 9/1984 Matsuoka ..... B60R 22/40 242/378.4
5,131,898 A * 7/1992 Panagos ..... A63B 21/072 482/106
6,537,183 B1 * 3/2003 McCrea ..... A63B 21/153 482/106
7,591,763 B1 * 9/2009 Fucci ..... A63B 21/4029 482/121
8,986,173 B1 * 3/2015 Adams ..... A63B 21/028 482/106
2004/0058789 A1 3/2004 Tsai
2004/0162197 A1 * 8/2004 Towley, III ..... A63B 21/0605 482/107
2005/0145435 A1 * 7/2005 Choate ..... A62B 35/0093 182/3
2009/0211847 A1 * 8/2009 Balquist ..... A62B 35/0093 182/231
2009/0211849 A1 8/2009 Smith et al.
2010/0204024 A1 * 8/2010 Mills ..... A63B 21/00069 482/130
2010/0308149 A1 * 12/2010 Allington ..... A62B 1/08 242/379
2011/0183821 A1 * 7/2011 Radi ..... A63B 21/00196 482/110
2012/0116259 A1 * 5/2012 McConnell ..... A63B 21/153 600/595
2012/0245004 A1 * 9/2012 Bremer ..... A63B 21/00185 482/129
2013/0165301 A1 * 6/2013 Thrasher-Rudd ..... A63B 7/00 482/129
2014/0228181 A1 * 8/2014 Powell ..... A63B 21/0442 482/115
2016/0067578 A1 * 3/2016 Matte ..... A63B 69/12 473/424

FOREIGN PATENT DOCUMENTS

WO WO 2007148333 A2 * 12/2007 ..... A63B 21/0004
WO 2008013750 A1 1/2008
WO 2008014500 A2 1/2008
WO 2013004734 A9 6/2013

* cited by examiner

EXERCISE DEVICE WITH ROTATABLE REELS

CROSS REFERENCE TO RELATED APPLICATIONS

This is a National Stage of International Application No. PCT/GB2014/052404, filed Aug. 6, 2014, which claims the priority of British Application No. 1314362.3, filed Aug. 11, 2013, the entire disclosures of which are hereby incorporated by reference in their entirety.

BACKGROUND OF THE INVENTION

1. Field of the Invention

This invention relates to an exercise device known as a body weight exercise device or "suspension trainer".

2. Description of the Prior Art

Such exercise devices have become popular and are generally based on gymnastic rings including an inelastic adjustable strap or rope centrally supported by an anchor that provides distribution between two arms of the strap or rope with a handle at an end of each opposed arm. Such an exercise device is disclosed in U.S. Pat. No. 7,044,896. The device enables a wide variety of exercises to be performed where a user's weight provides resistance that may be varied by the angle of the user's body in relation to the floor and anchor point—the more upright the user stands the less resistance and the more the user leans their body away from the anchor point, the greater the resistance. An exercise device, such as that disclosed in the U.S. patent, is relatively easy to use and can provide a user with a full body workout.

The exercise device of the aforesaid U.S. patent is shown in the accompanying FIG. 1, where a user U is attempting to perform a triceps dip. The exercise device has an anchor A securely attached to a beam B. Suspended from the anchor is a hook or loop H, from which is supported a single inelastic strap forming two lengths LL and LR, with, at opposing ends of the lengths LL and LR, handles, or grips LG, RG, respectively.

However, the exercise device disclosed in U.S. Pat. No. 7,044,896 has a number of disadvantages, namely:

1. With such an exercise device, the single strap S provides little clearance for the user's body so that the straps obstruct and chafe at points C on a user's arms and shoulders, making exercises awkward and, occasionally, painful. Thus, at points C the straps chafe on the user's arms and shoulders and dimension D shows the narrowing distance between the straps. Therefore, it will be seen at no point along the length of the straps is dimension D sufficiently wide to comfortably fit a user's body.

2. By being anchored at a single point, swinging and/or twisting when a user is fully suspended, may be caused which limits the number of configurations for exercise that can be adopted.

3. Length adjustments of the straps, as shown in U.S. Pat. No. 7,044,896, is performed by a buckle located approximately half way along the length of the lengths LL and LR. Adjustment by the buckle requires two hands so that a user has to stop exercise, release the handles, LG/RG, and adjust each strap individually. The flow of a workout is, thus, interrupted and adjustment can be time consuming.

4. Because the strap S is a single length, it can become tangled, especially when the exercise device is being packed for storage.

5. By virtue of using buckles, as disclosed in U.S. Pat. No. 7,044,896, when the lengths LL and LR of the strap S is shortened, so the loosened portion may dangle into the exercise zone of a user and become tangled or become an annoyance.

6. The minimum strap length that is achievable is limited to approximately half the maximum length so that shorter strap lengths are not possible, thereby limiting the number of configurations and exercises that may be enabled.

7. The exercise device shown in U.S. Pat. No. 7,044,896 is limited for use as a suspension trainer and requires a suitable mounting point.

The present invention seeks to at least partially mitigate one or more of the fore-noted problems.

SUMMARY OF THE INVENTION

According to this invention there is provided an exercise device including a pair of axially spaced rotatable reels having axes in vertically offset planes, spring bias means arranged to bias each said reel in a direction of rotation, each said reel having associated therewith an inelastic strap, and selectably releaseable locking means arranged to release and lock said reels from rotation, wherein each said reel is arranged to extend a respective one of said straps against the bias of said spring bias means or to rewind said strap about a respective reel under the influence of said spring bias means.

Preferably, spring bias means is provided for each said reel.

Conveniently, the locking means is arranged to simultaneously lock or unlock both said reels from rotation.

Advantageously, each said reel, when unlocked by said locking means, is arranged to rotate independently of the other said reel so that the length of strap deployed from each said reel is selectably variable.

Conveniently, each said reel comprises a pair of axially spaced sprockets and said strap is arranged to be wound around an axle spacing said sprockets, and one distal end of said strap is arranged to be attached to said axle.

Alternatively, each said reel comprises a single sprocket toward one end of an axle about which said strap is wound.

Preferably, said spring bias means is at least one spiral spring connected to said axle, whereby said sprockets are rotatable with or against the bias of said at least one spiral spring.

Advantageously, a spiral spring is provided at each opposing end of said axle.

Preferably, said locking means includes a pivoted arm having at opposed ends thereof a transverse member arranged to inter-engage between teeth of the axially spaced sprockets. It is envisaged that the transverse member may engage with only one sprocket on each said axle.

Advantageously, the transverse member is manually movable by a user to pivot the arm so that the transverse member is movable to simultaneously lock or unlock the axially spaced sprockets from rotation of at least one said reel.

Preferably, the arm is spring biased to lock the sprockets from rotation and said transverse member is movable by a user against the spring bias to enable rotation of the sprockets.

Advantageously, each said reel, when released by the locking means, is arranged to rotate independently of the other reel in either direction at a speed controlled by a user.

Conveniently, an end of the strap remote from said distal end attached to the axle is arranged into a loop to secure a carabiner.

Advantageously, a plurality of longitudinally spaced hoops are provided on the strap adjacent to the carabiner to facilitate the attachment of a carabiner of another strap.

Conveniently, the reels and locking means are located within a casing, said casing being generally dumbbell-shaped with the reels being longitudinally axially spaced apart and each located in a drum-shaped end, and said drum-shaped ends being interconnected by a member forming a handle.

Advantageously, each drum-shaped end of the casing has a circumferential portion on which is provided a planar surface and on one said planar surface of one drum-shaped end is provided a male connector and on the other said planar surface of the other drum-shaped end is provided a female connector, whereby two exercise devices may be secured together by interlocking respective male and female connectors so as to create one double handle or two single handles.

Preferably, said casing is provided in two longitudinally conjoined halves, with the reels and locking means located between the two halves and the spring bias means being located in an outer portion of each drum-shaped end.

Advantageously, mounted on an opposite side of said drum-shaped end to respective male and female connectors is a rubber foot for engagement with the ground.

In a further embodiment, each said reel comprises a single sprocket toward one end of an axle about which said strap is wound.

In the further embodiment, preferably a spiral spring is provided at only one end of said axle.

In said further embodiment, conveniently the reel has a longitudinally extending diametric slot therein and an axle, wherein the straps are inserted through the slot and secured in overlapping manner about the axle.

In said further embodiment, advantageously the locking means comprises the sprocket attached to the reel and a spring biased manually operable shaft slideably mounted in a barrel, said shaft and barrel each having a cut-out therein disposed along a longitudinal axis thereof, said cut-outs having a width greater than a width of the sprocket, whereby the sprocket is arranged to locate through the cut-out in the barrel, and the shaft has at least a portion thereof having a full diameter sufficient to locate between the teeth of the sprocket, and translational motion of the shaft within the barrel permits the sprocket to rotate within the cut-outs of the barrel and shaft, or to have rotation thereof arrested by said full diameter of the shaft engaging between adjacent teeth of the sprocket.

In said further embodiment, advantageously the shaft is prevented from rotation within the barrel by a pin located transverse to the longitudinal axis of the shaft, which said pin engages within a diametric slot in the barrel.

The invention will now be described, by way of example, with reference to the accompanying drawings in which:

DETAILED DESCRIPTION OF A PREFERRED EMBODIMENT

Figure 1:
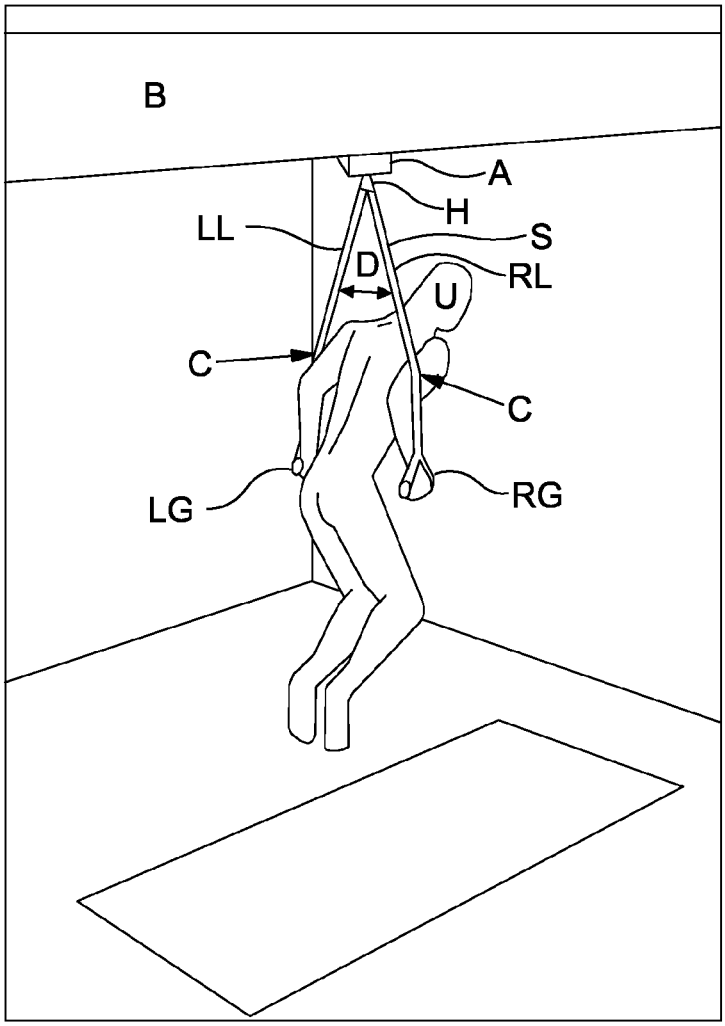
FIG. 1 shows a prior art exercise device, described hereinabove.

In the Figures like reference numerals denote like parts.

Figure 2:
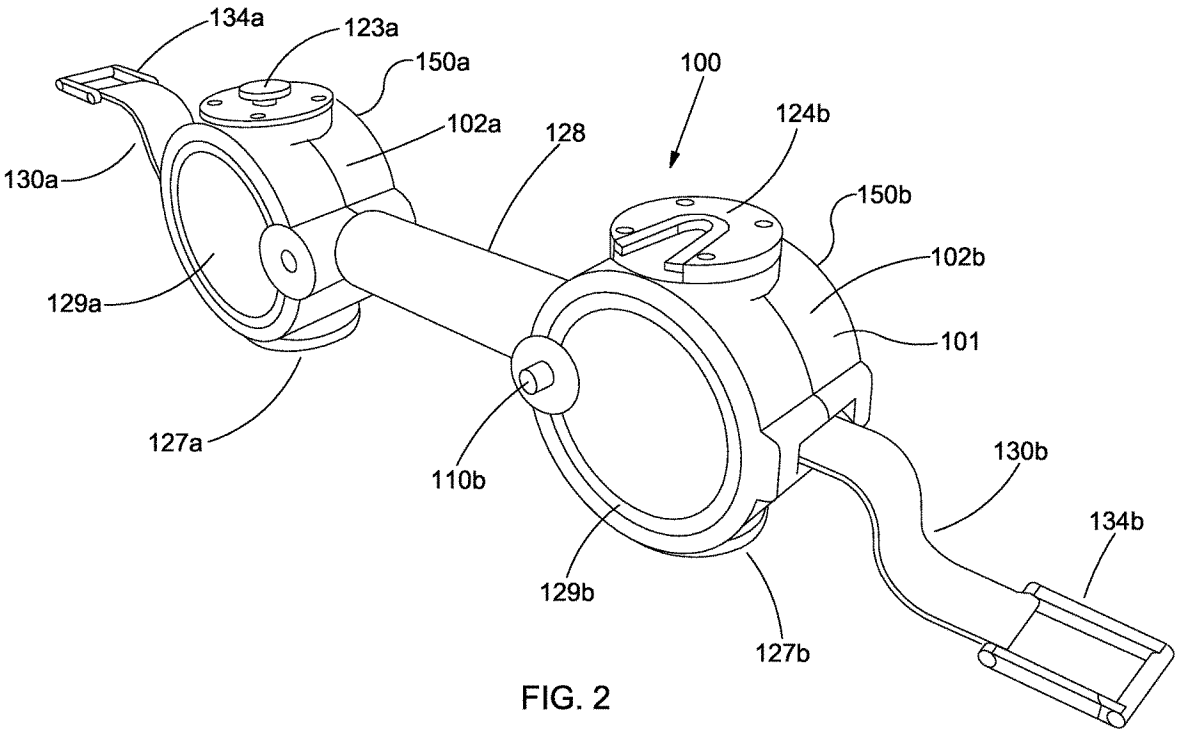
FIG. 2 shows a perspective view of an exercise device in accordance with this invention.

The exercise device 100 of this invention shown in FIG. 2 has a longitudinally split casing 101 comprising a pair of drum-shaped ends 150*a*, 150*b*, interconnected by a member forming a handle encased by a grip, for example a rubber grip, 128. The casing 101 may be formed of metal or plastics material and is, preferably, formed in a mould. In this description, the exercise device will be referred to as having end a and end b. On opposed planar sides of each drum-shaped end 150*a*, 150*b* is a cover 129*a*, 129*b*, for example made of plastics, and also a lock/release button 110*a*, 110*b*. The upper circumferential surface of each drum-shaped end 150*a* is surmounted by a male connector 123*a* and the upper circumferential surface of drum-shaped end 150*b* is surmounted by a female connector 124*b*, although it is to be understood that the male and female connectors may be interposed. Diametrically opposite the male and female connectors is a foot, for example made of rubber, 127*a*, 127*b*.

Spirally wound within each drum-shaped end is an inelastic strap 130*a*, 130*b* which may be made of nylon and each strap at its outer end is terminated in a carabiner 134*a*, 134*b*.

Figure 20:
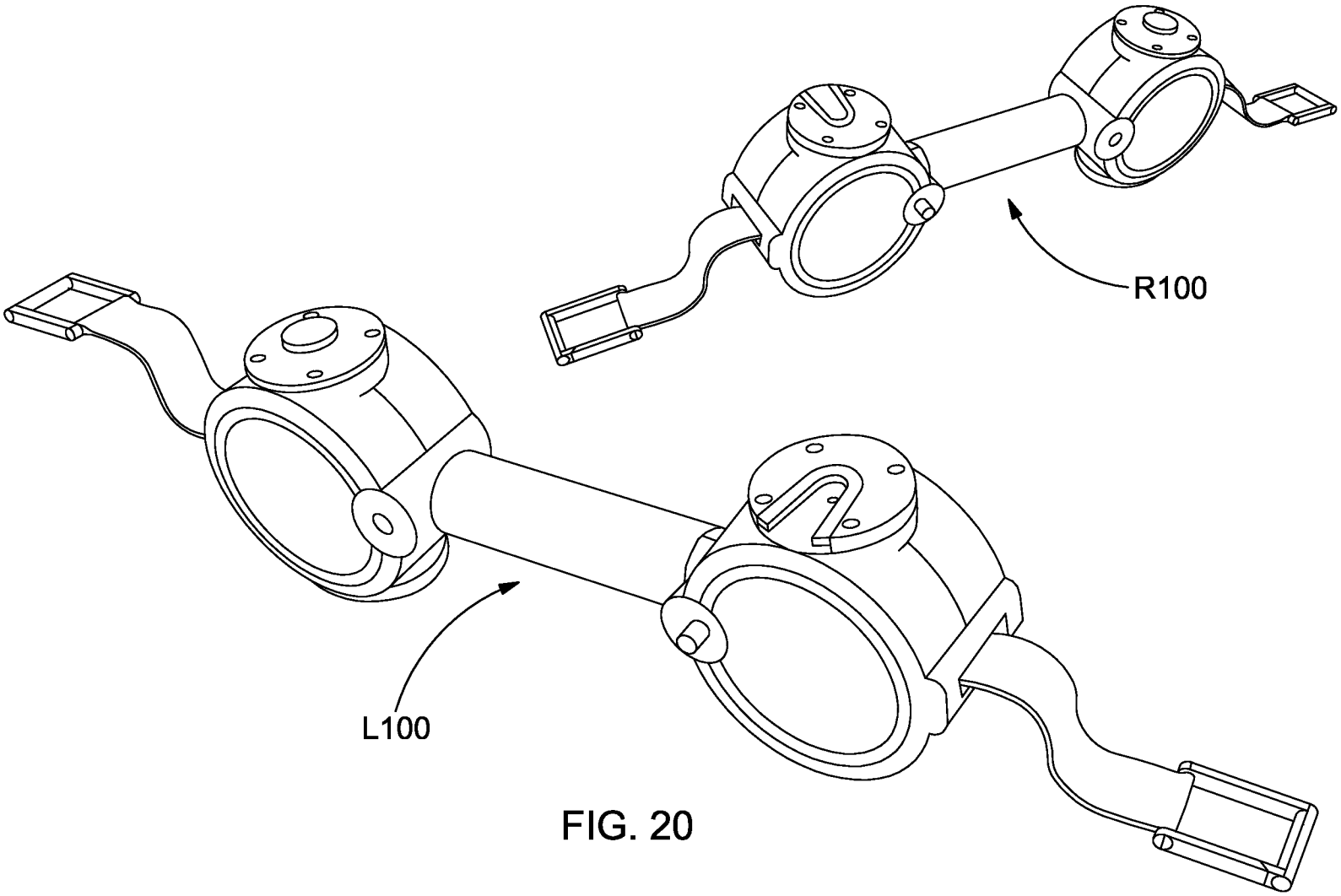
FIG. 20 shows a perspective view of a pair of exercise devices each in accordance with this invention.

Two exercise devices, each in accordance with this invention, are shown in FIG. 20 and are denoted L100 and R100. As used herein, components are labelled as L for left and R for right so that a reference number prefixed by an L refers to a left device, and a number prefixed with an R refers to a right device, although it is to be understood that the terms left and right may be interchanged in use of practical embodiments.

Figure 21:
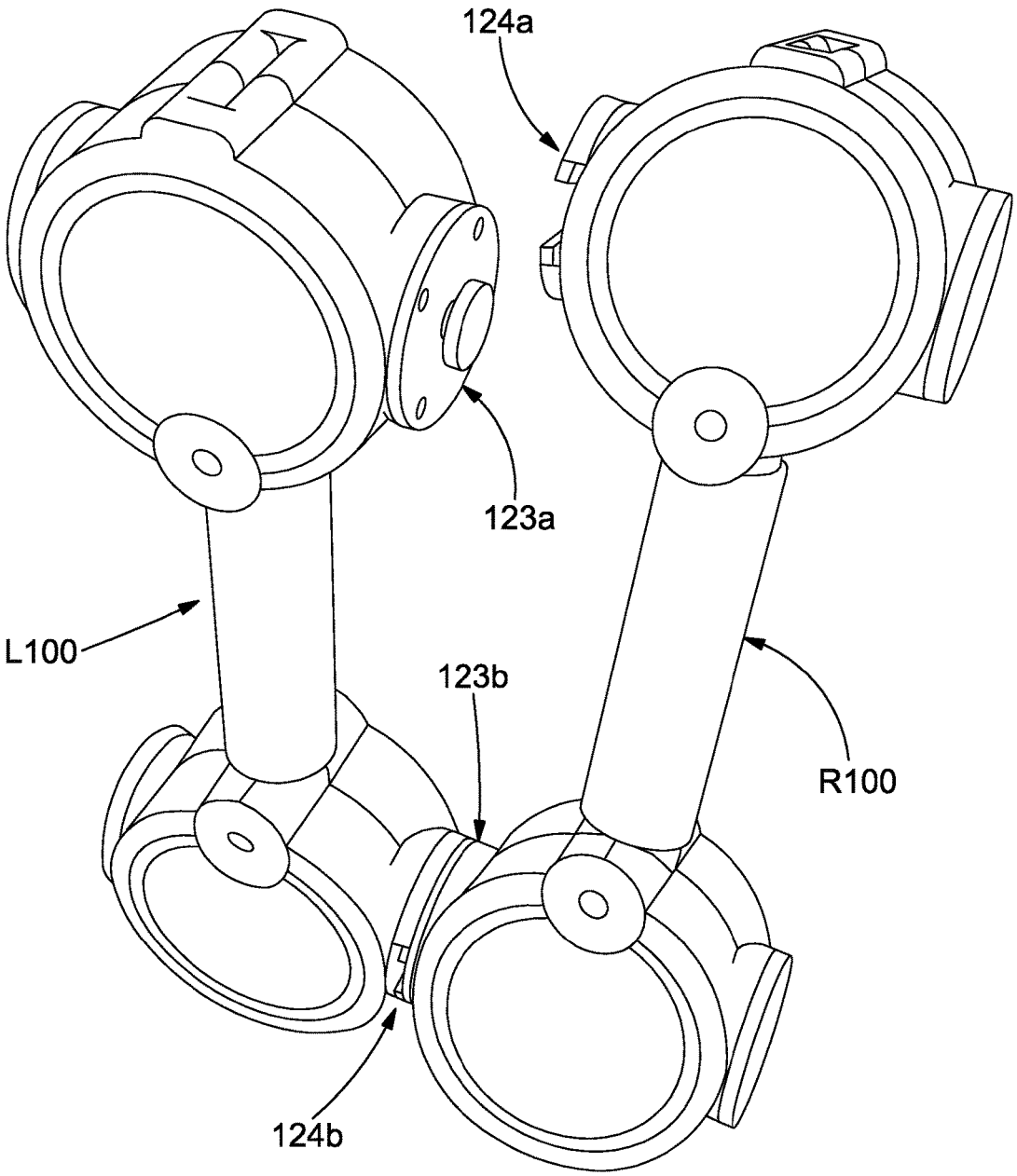
FIG. 21 shows a perspective view of the devices shown in FIG. 20 being connected together.

FIG. 21 shows two exercise devices each in accordance with this invention being slidably interconnected together with one end of male connector 123*b* and female connector 124*b* connected together and with another male connector 123*a* and another female connector 124*a* slightly apart and ready to be slidingly engaged. It is to be understood that the ability to interconnect two exercise devices together is optional.

Figure 3:
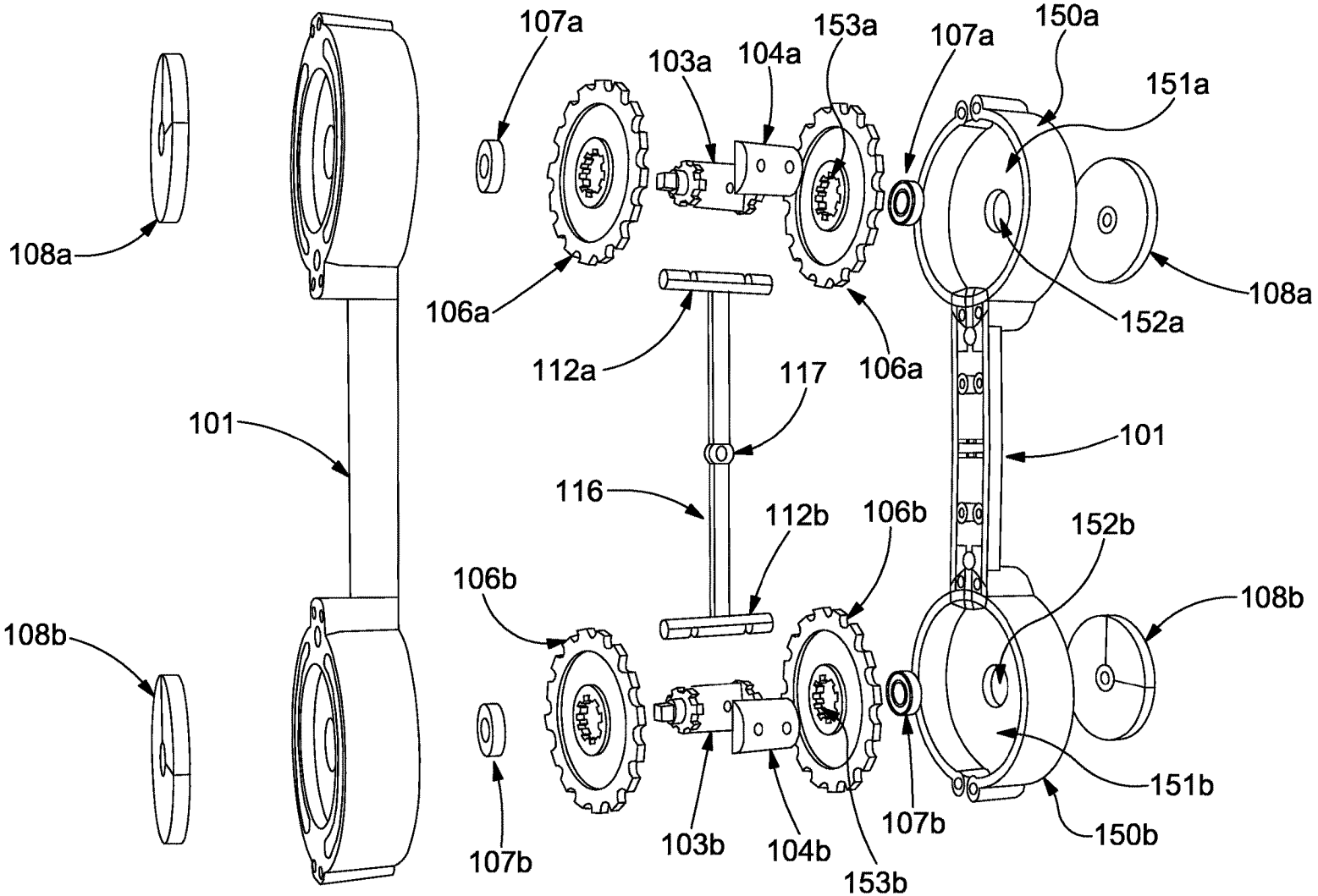
FIG. 3 shows an exploded perspective view of an exercise device in accordance with this invention.
Figure 4:
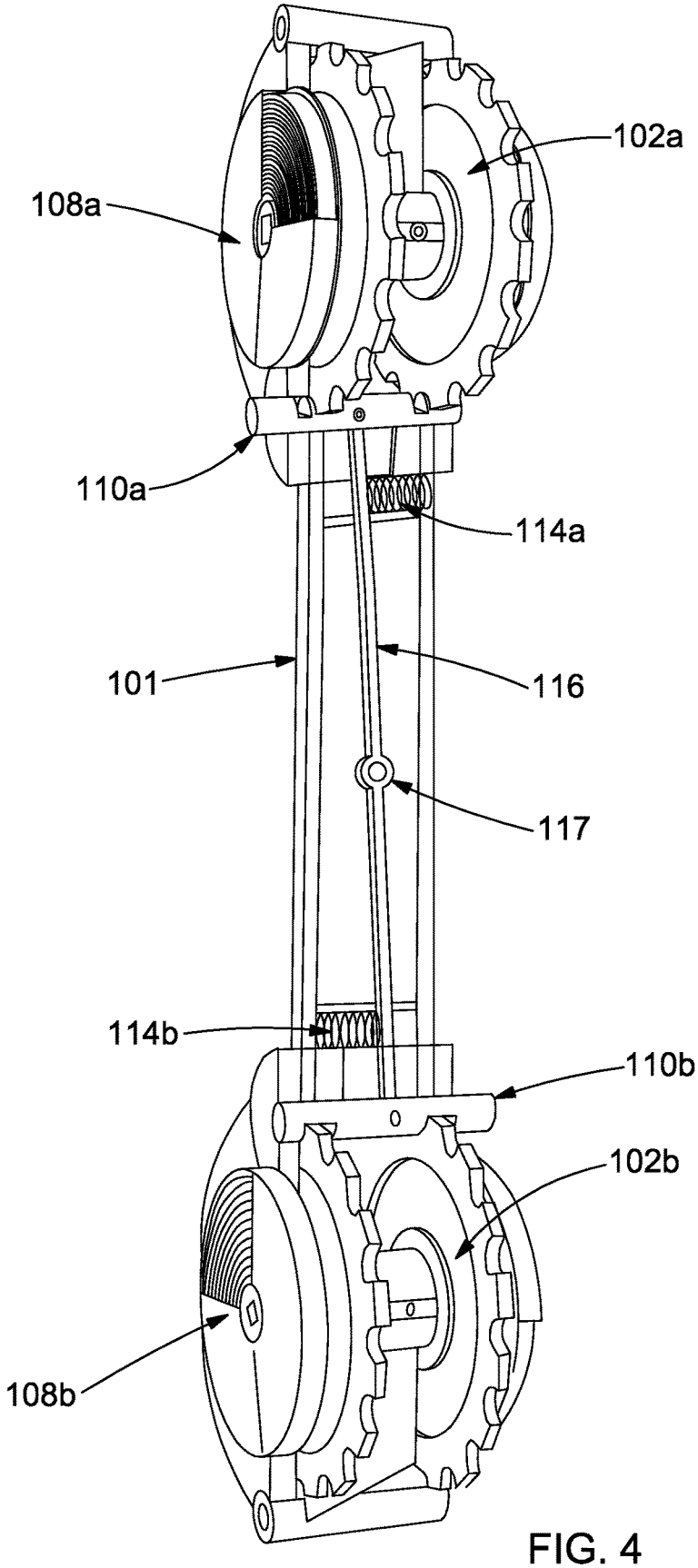
FIG. 4 shows a perspective longitudinal cut away section through a casing of the device in accordance with this invention.
Figure 5:
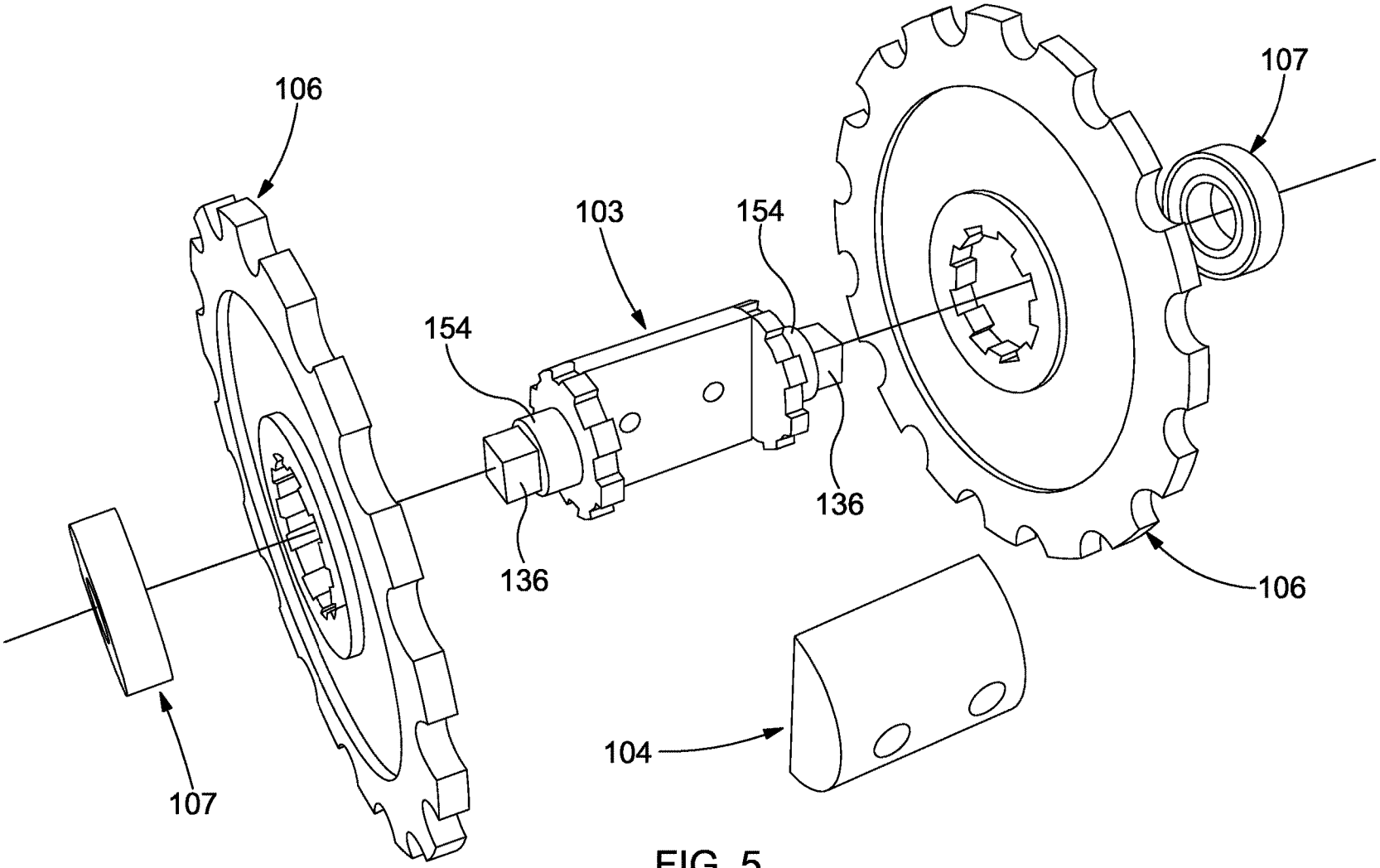
FIG. 5 shows an exploded perspective view of a reel used in the exercise device of this invention.
Figure 6:
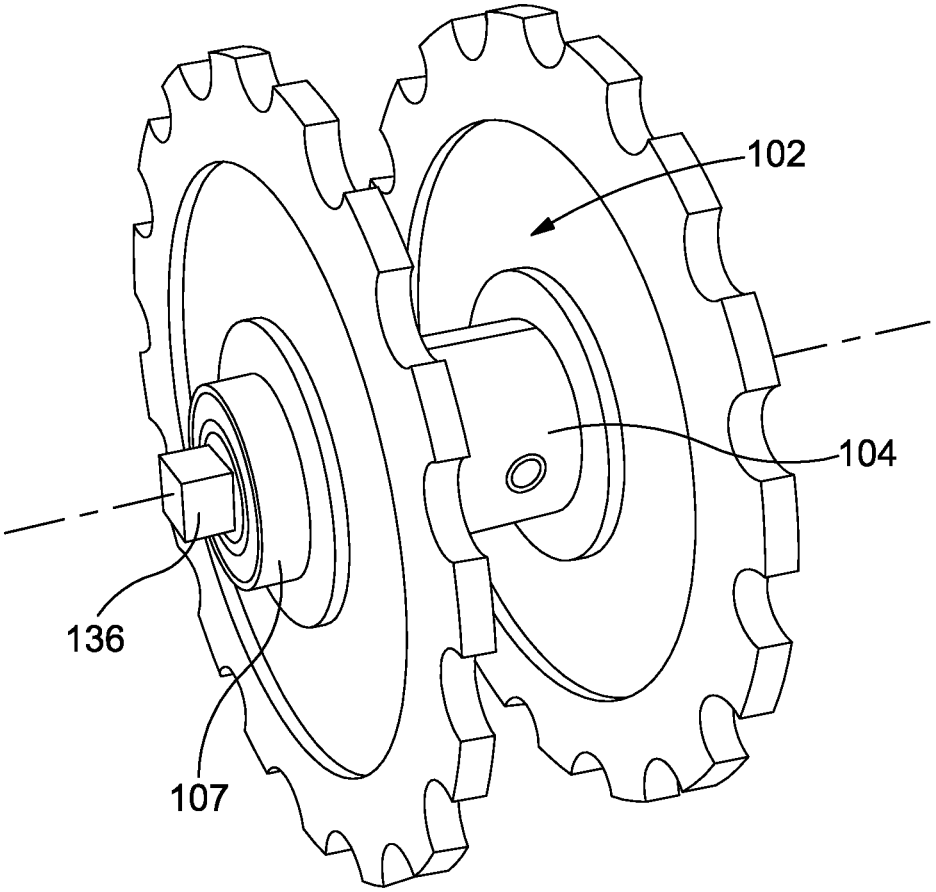
FIG. 6 shows the assembled reel of FIG. 5.
Figure 7:
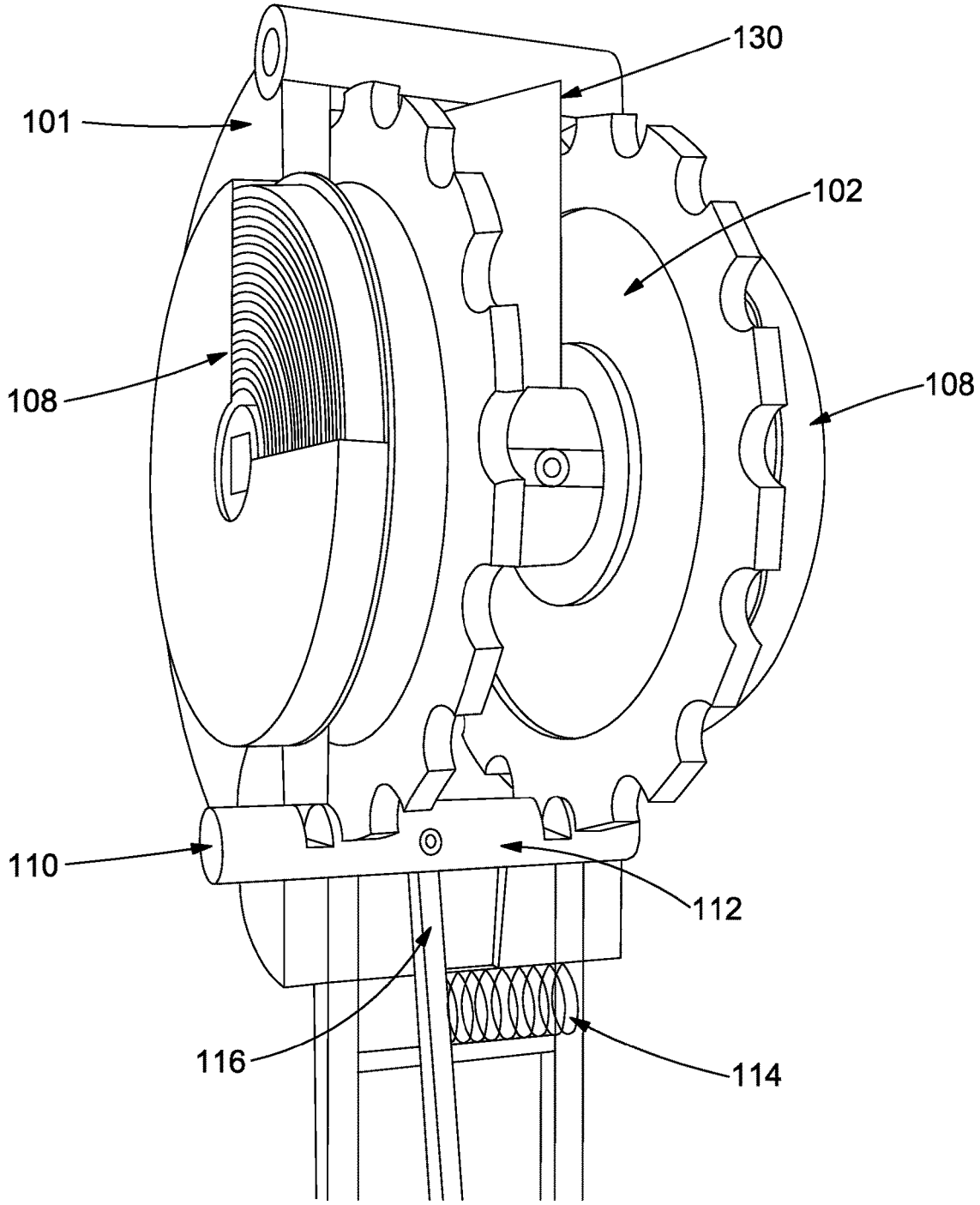
FIG. 7 shows a perspective part view of the locking mechanism of the exercise device in a locked position with the casing cut away.
Figure 8:
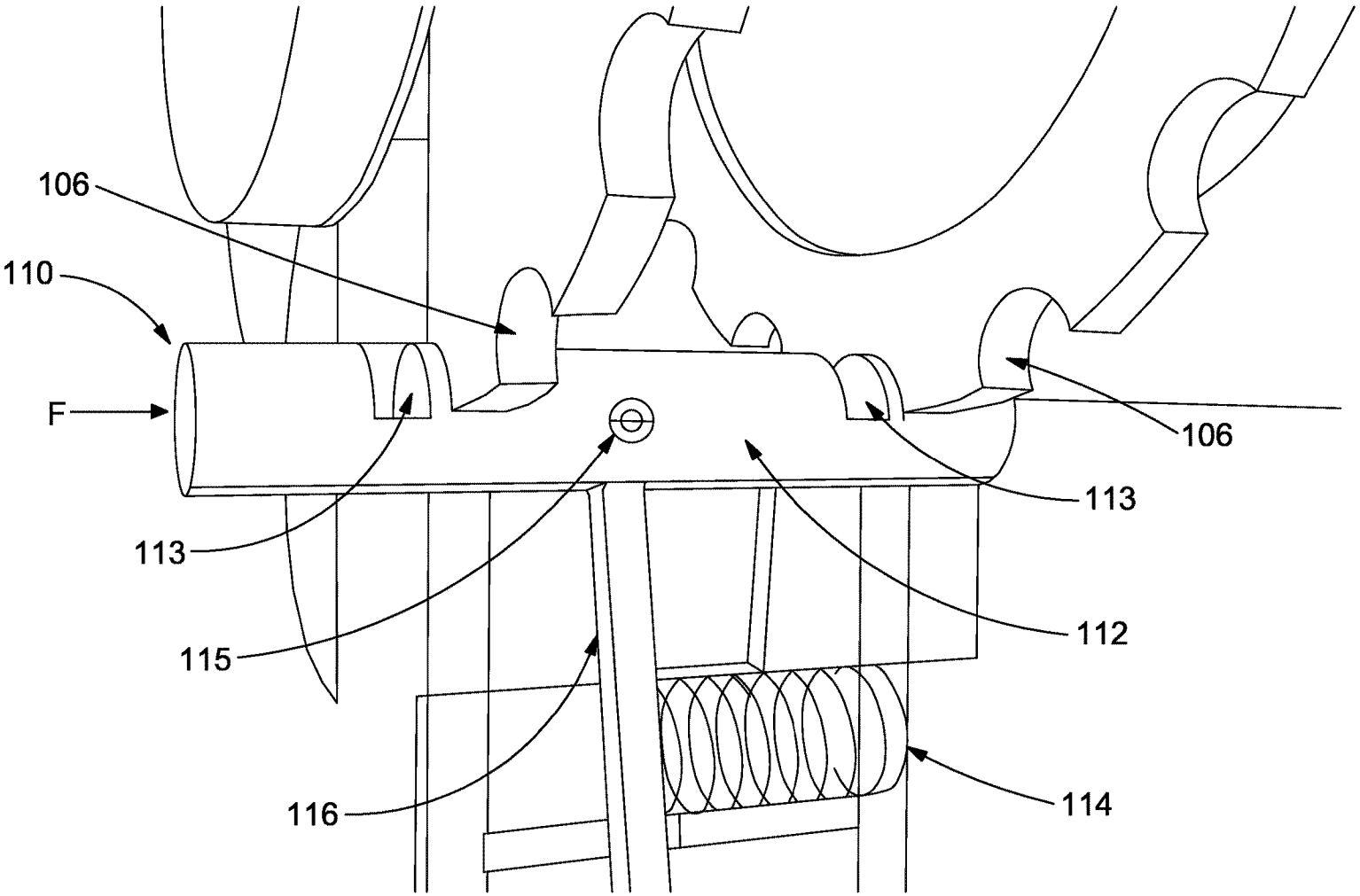
FIG. 8 shows in greater detail a perspective view of the locking mechanism of the device of the invention in a locked position.
Figure 15:
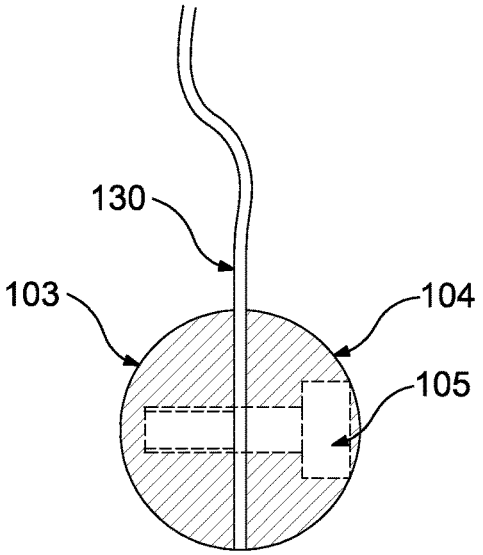
FIG. 15 is a cross-section along double arrow-headed lines XV-XV of FIG. 14.

The exploded perspective view of FIG. 3 shows that the casing 101 is in two symmetrical halves and that components are arranged symmetrically in each half. The drum-shaped end 150*a*, 150*b* has its internal area divided by an annular plate 151*a*, 151*b*. A ball race bearing 107*a*, 107*b* is inserted into an axial hole 152*a*, 152*b* of the annular plate and a sprocket 106*a*, 106*b* is mounted on the bearing. The sprocket 106*a*, 106*b* has an internally castellated hole 153*a*, 153*b* for receiving mating castellations on a spindle 103*a*, 103*b*. The spindle has, at opposing ends, an outer square cross-sectional end so as to form a square drive 136, and a circular portion 154 (shown in FIG. 5) for mounting inside the bearing 107*a*, 107*b*. The spindle 103*a*, 103*b* has an internal planar surface which is complimentary with a planar surface of a strap retaining segment 104*a*, 104*b*. The components 107, 106, 103, 104 form a reel 102 which is shown in exploded form in FIG. 5 and in assembled form in FIG. 6. The strap 130 is retained between the planar surfaces of the spindle and strap retaining segment, as best shown in FIG. 15, by a pair of screws 105 having heads which are located within recesses in an outer surface of the segment 104 and which threadingly engage internally threaded screw holes in the spindle 103.

Located on the opposite side of the annular plate 151*a*, 151*b* from the reel 102*a*, 102*b* is a spirally wound tension spiral spring 108*a*, 108*b*, in each casing half.

Figure 12:
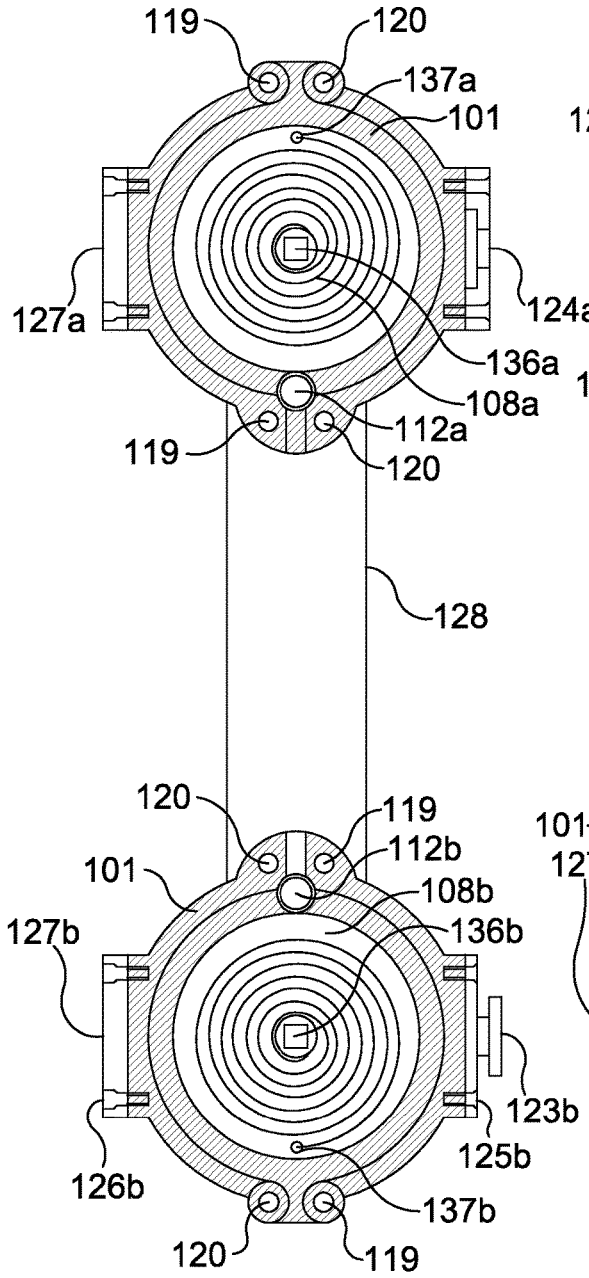
FIG. 12 shows a longitudinal cross-section along double arrow-headed lines XII-XII of FIG. 10.

As best shown in FIG. 12, a radially inner end of the spring 108 is secured to the square drive 136 and a radially outer end of the spring 108 is secured to a peg 137*a*, 137*b* secured to the casing 101 so that the square drive 136 may be rotatingly driven by the spiral spring.

Referring now to FIGS. 3, 4, 8, 10, 11, 12, 13 and 14, generally located in the longitudinally central part of the casing 101 is a lever arm 116 that pivots about a pivot pin 117 which is journaled in a nylon bush 118 located in each casing half. At remote ends of the lever arm 116 are transverse locking shafts 112*a*, 112*b* that have outer surfaces which are complimentary with and arranged to mate internally with recesses between the teeth on each sprocket 106*a*, 106*b*. An outer end of the shafts 112*a*, 112*b* form the forementioned button 110*a*, 110*b*. Compression coil springs 114*a*, 114*b* working in opposite directions on opposing sides of the pivot pin 117 act on the lever arm against the casing 101. At each opposite end of the lever arm 116 are longitudinally elongated holes 111*a*, 111*b* within which is located a pivot pin 115*a*, 115*b*. The pivot pin 115*a*, 115*b* is fixedly secured to locking shafts 112*a*, 112*b*, which shafts are slideable transverse to the longitudinal axis of the casing 101. Shaft 112 is provided with a pair of grooves 113*a*, 113*b* which are wider than the width of a respective sprocket 106 so that when the grooves 113 are aligned with the sprockets, so the sprockets are permitted free movement of rotation. The sprockets 106 and locking shaft 112 are, preferably, made of hardened steel to reduce wear.

Figure 10:
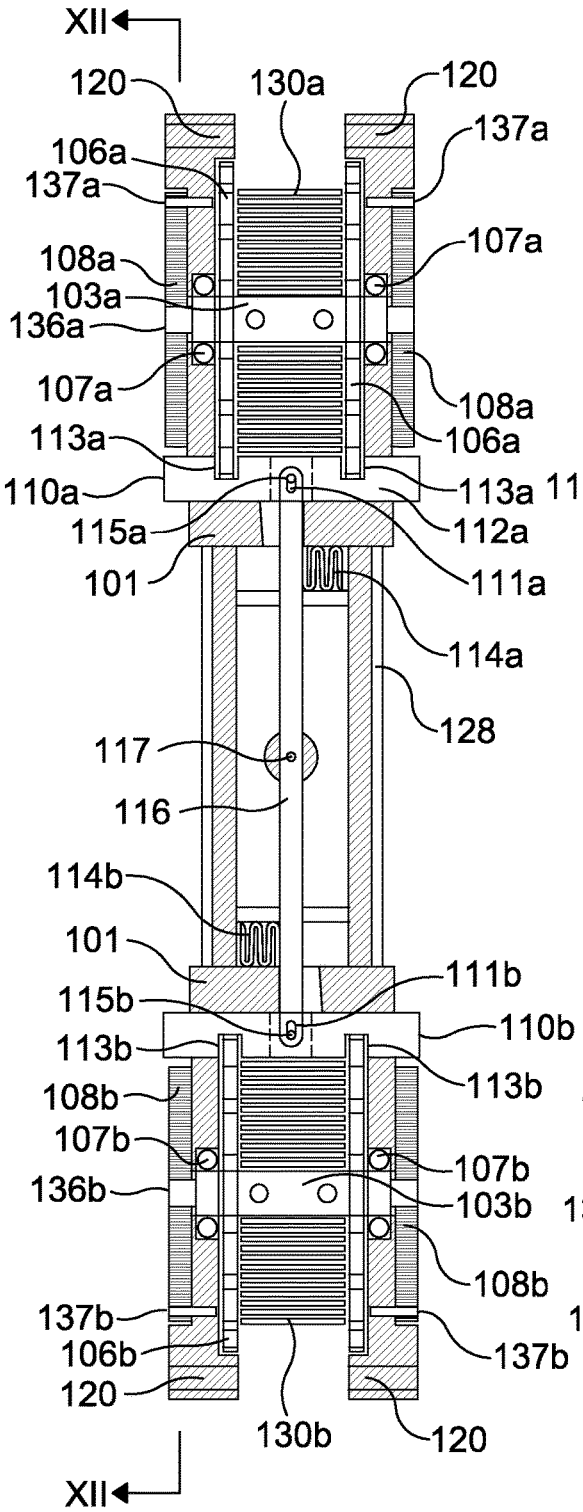
FIG. 10 shows a longitudinal cross-section of an exercise device in accordance with this invention with the strap locking mechanism in an unlocked position.
Figure 11:
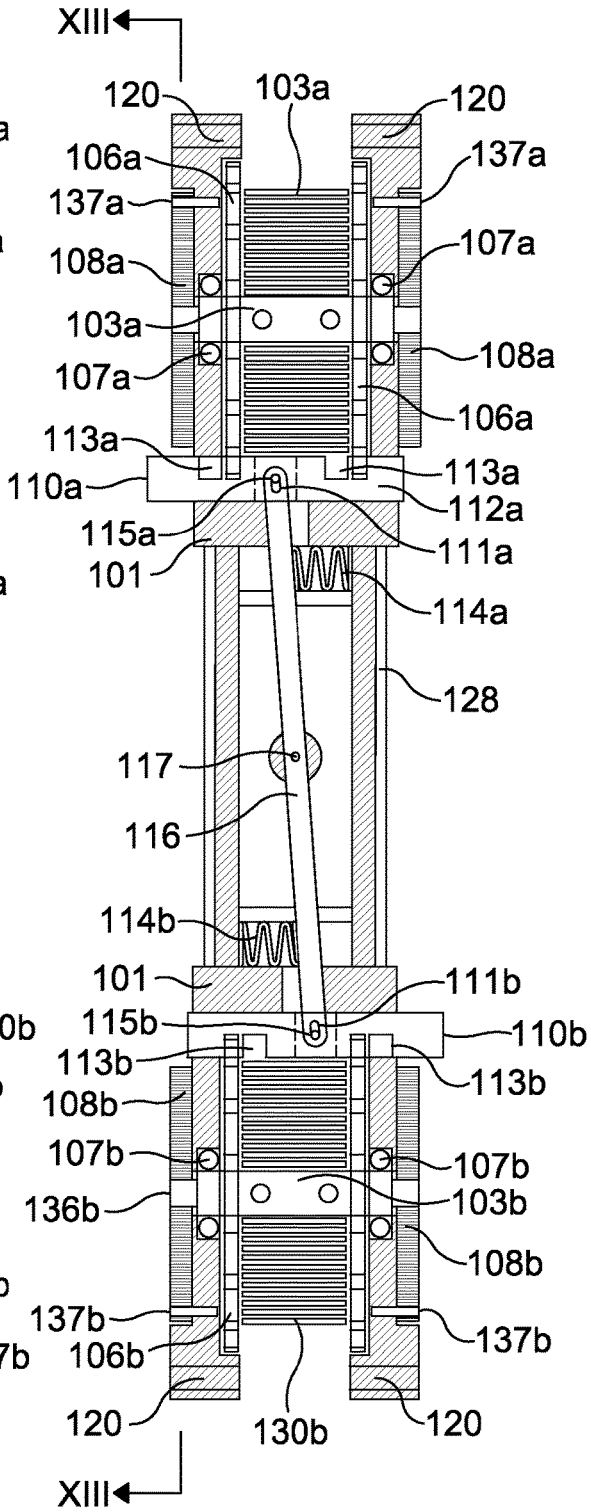
FIG. 11 shows a longitudinal cross-section of an exercise device in accordance with this invention with the strap locking mechanism in a locked position.

Referring to FIG. 10, the lever arm is in a position to permit free rotation of the sprockets 106, thereby enabling the sprockets to be rotated by the spiral spring 108 and the strap to be either withdrawn or extended in dependence upon force exerted by a user. Thus, in this position the sprockets are unlocked.

Figure 9:
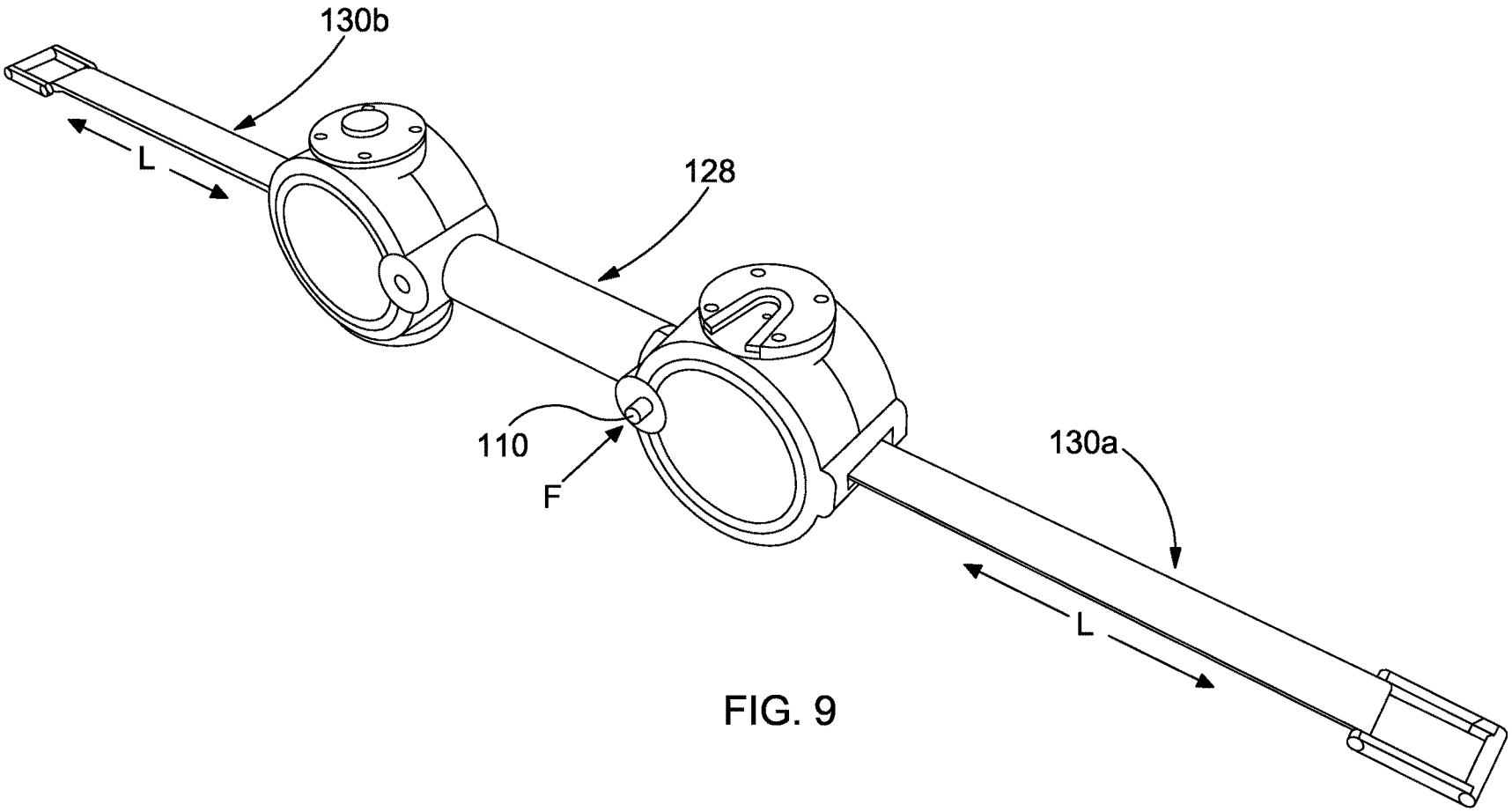
FIG. 9 illustrates a perspective view of adjustment of the straps of the device of the invention.
Figure 26:
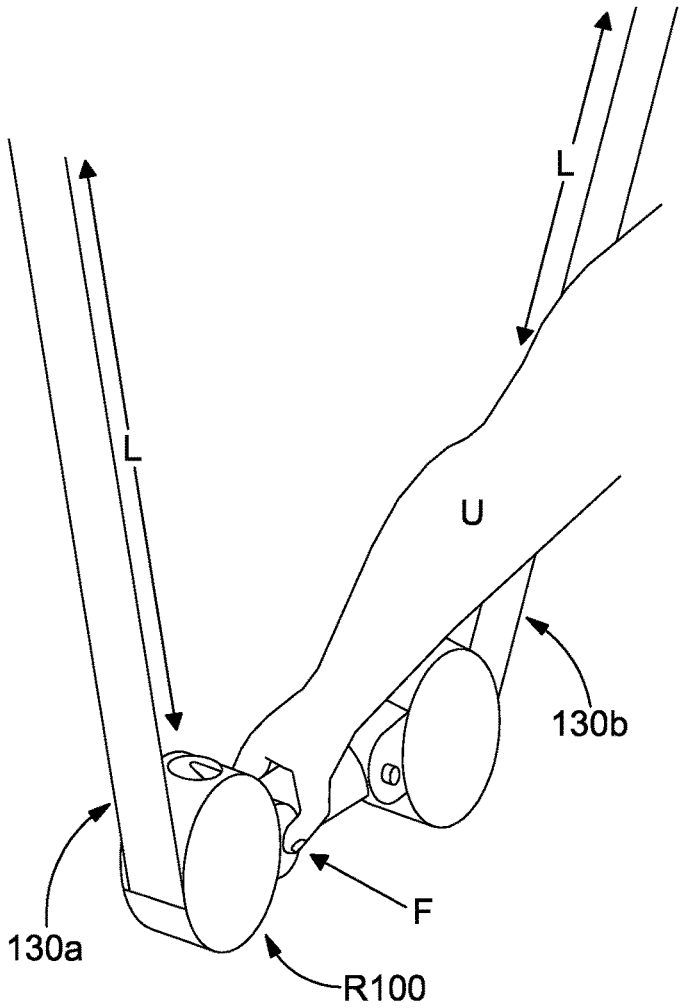
FIG. 26 shows a perspective view of a lock/release button being depressed to adjust the length of the straps.

Thus, to obtain this unlocked position pressure is being exerted in the direction of arrow headed line F by a user U on button 110, as shown in FIG. 26, against the force of spring 114 to cause translational movement of shaft 112 to the position shown in FIG. 10. Release of force F by a user U enables the pressure exerted by spring 114 to act against arm 116 to move the shaft 112 to the locked position shown in FIGS. 7, 8, 11 and 14, whereby the teeth of the sprockets 106 engage with the complimentary surface of the shaft 112 to prevent the sprockets 106 from rotating. In this position the sprockets are locked, and, thereby, the strap associated therewith is also locked from being withdrawn or rewound. Therefore, as shown in FIG. 9, depression of button 110 by applying force F unlocks the sprockets to permit rotation so that the length L of the strap may be increased or decreased.

The two halves of the casing are held together by bolts (not shown) extending through complimentary holes 120 into internally threaded holes 119.

Figure 13:
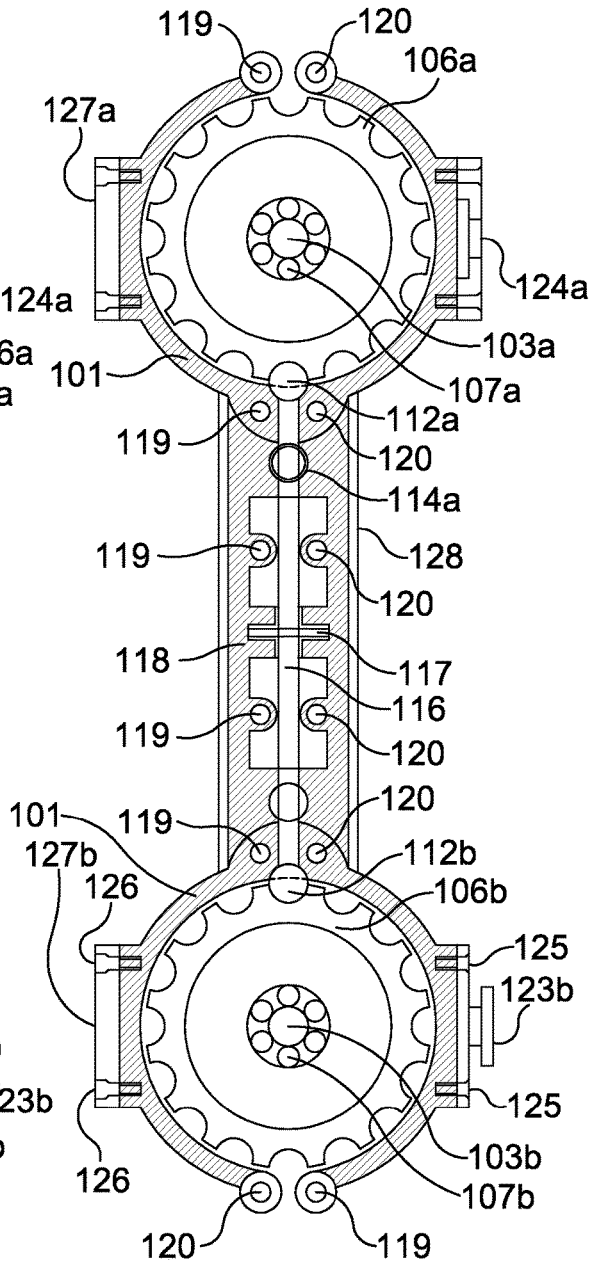
FIG. 13 shows a longitudinal cross-section along double arrow-headed lines XIII-XIII of FIG. 11.
Figure 14:
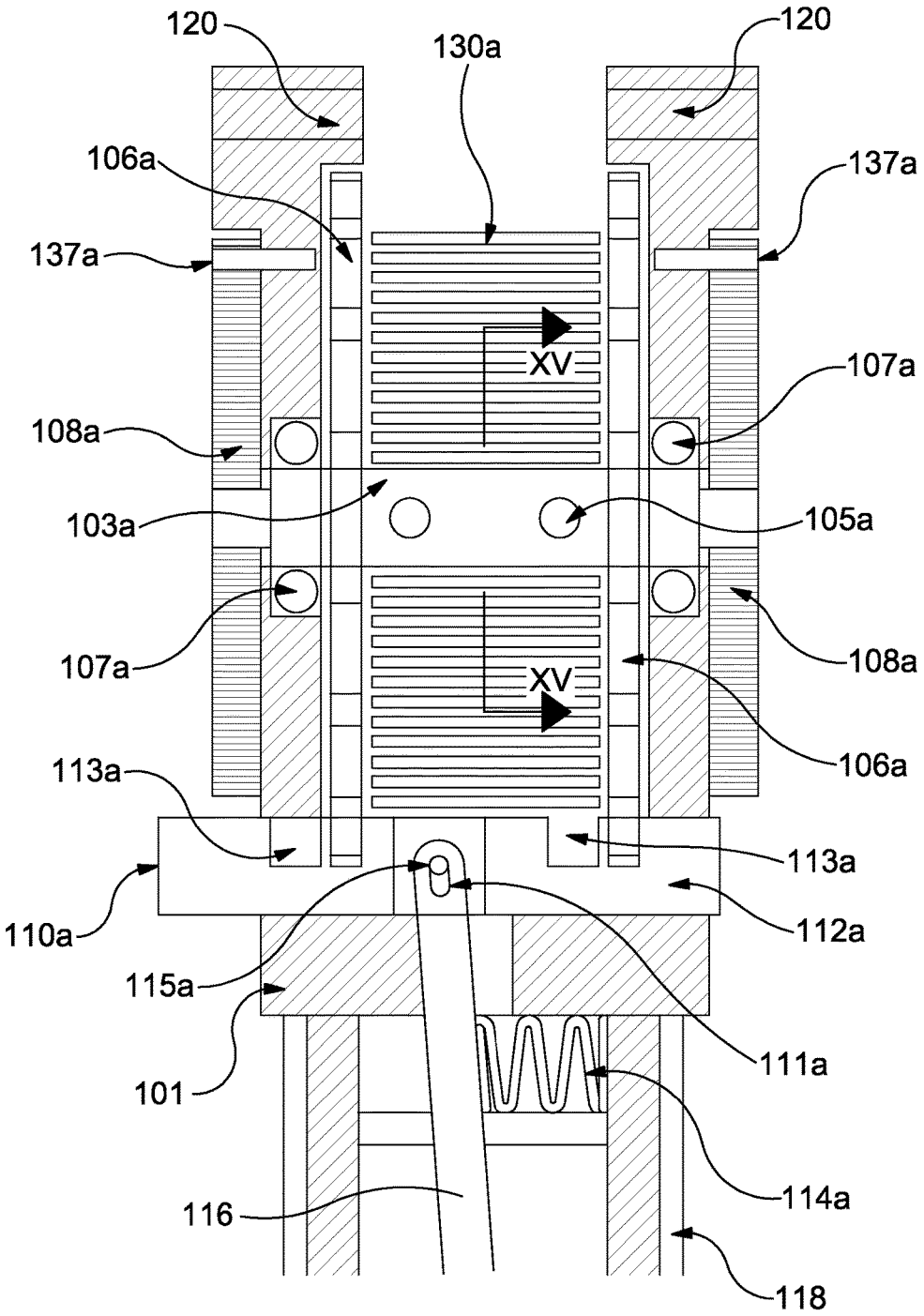
FIG. 14 shows in detail the locking mechanism of the exercise device of this invention.

The male connector 123 and female connector 124 are secured to the casing by countersunk screws 125 and the feet 127 are connected to the casing by countersunk screws 126 (as shown in FIGS. 12, 13).

Figure 16:
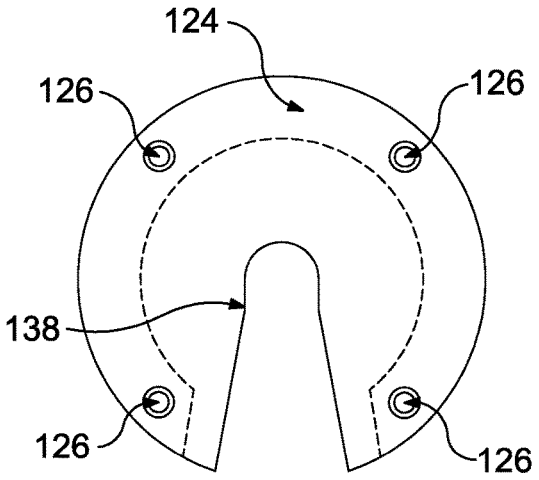
FIG. 16 is a top elevation of a female connector of an exercise device in accordance with this invention.
Figure 18:
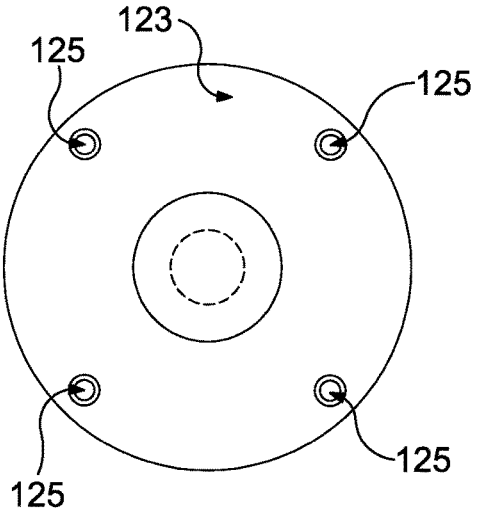
FIG. 18 is a top view of a male connector of an exercise device in accordance with this invention.
Figure 17:
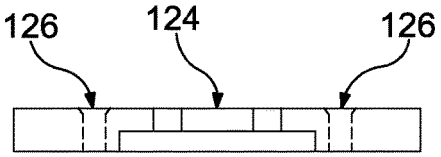
FIG. 17 is a side view of the female connector shown in FIG. 16.
Figure 19:
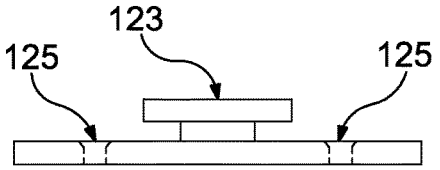
FIG. 19 is a side view of the male connector shown in FIG. 18.

So as to permit sliding and secure engagement between the male and female connectors 123, 124, so a cam shaped recess 138 is formed in the female connector 124, as shown in FIG. 16.

Figure 22:
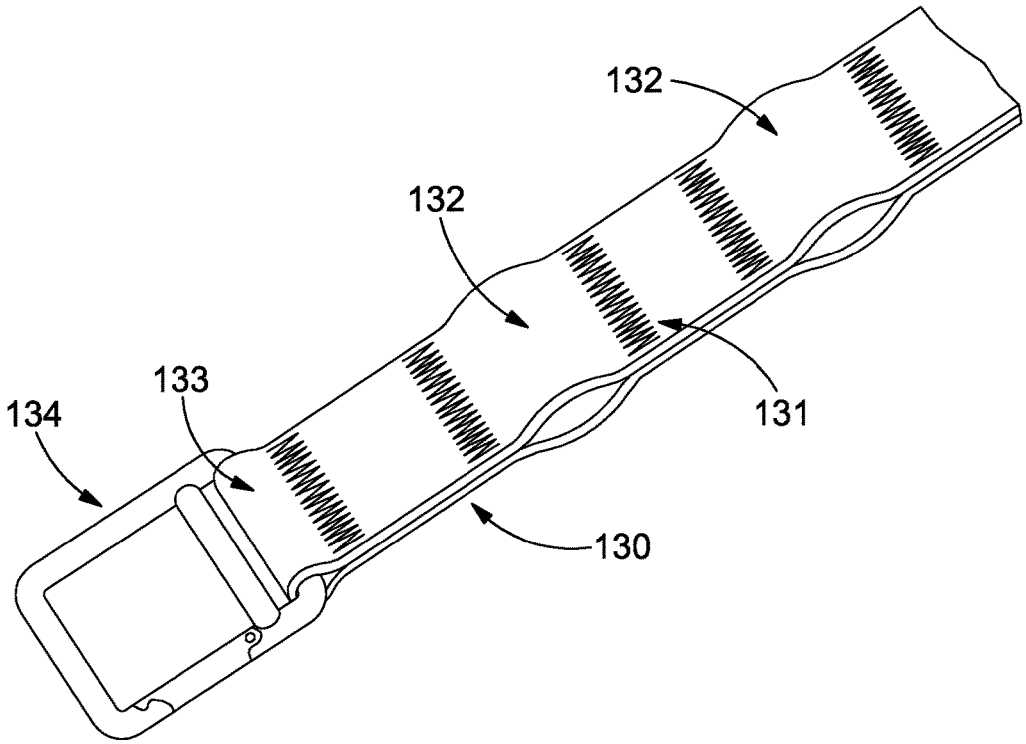
FIG. 22 shows a perspective view of a strap connected to a carabiner.
Figure 23:
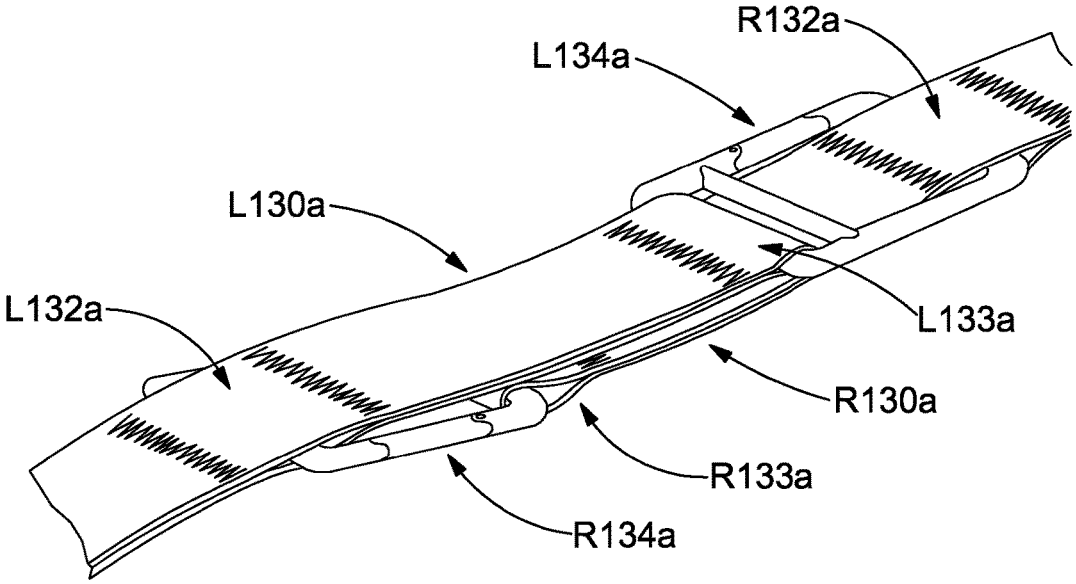
FIG. 23 shows a perspective view of two straps being connected together.

Referring now to FIG. 22, the strap, at least at its outer ends, is formed of a double thickness so as to form hoops 132 created by stitching 131 with an end hoop or loop 133 fixedly locating the carabiner 134. The provision of hoops 132 allows a wide range of fixing methods for different set-ups, whereby the carabiners 134 may be clipped over their own fixing strap to form a noose over an anchor point. Further, the carabiners L134*a* and R134*a* may be hooked through the stitched hoops of another strap 130 to join two straps L130*a* and R130*a* together, as shown in FIG. 23.

Figure 27:
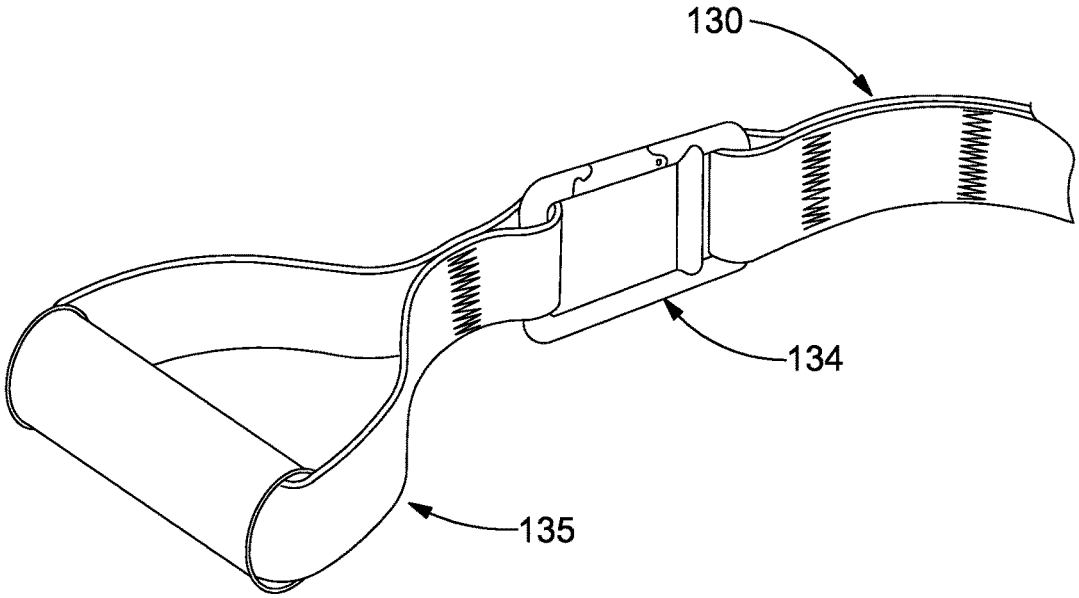
FIG. 27 shows a perspective view of an auxiliary handle attached to a strap.

As shown in FIG. 27, an auxiliary handle 135 may be attached to the carabiner 134. Such auxiliary handles may be nylon gym handles known per se as used with existing cable exercise machines.

To assemble the device, the internal parts are firstly assembled and placed in one half of the casing 101, with the straps 130 pre-wound on the reels 102 prior to locating the other casing half, and securing with bolts through holes 120 into internally threaded screw holes 119. The spiral springs 108 are pre-loaded, then fitted into the outer portion casing for easy access if maintenance is required. The rubber grip 128 is then affixed to the handle by, for example, gluing, and plastic covers 129 fitted onto the casing to cover the springs 108. The rubber feet 127 and connectors 123 and 124 are then affixed by screwing to form the device shown in FIG. 2.

Figure 24:
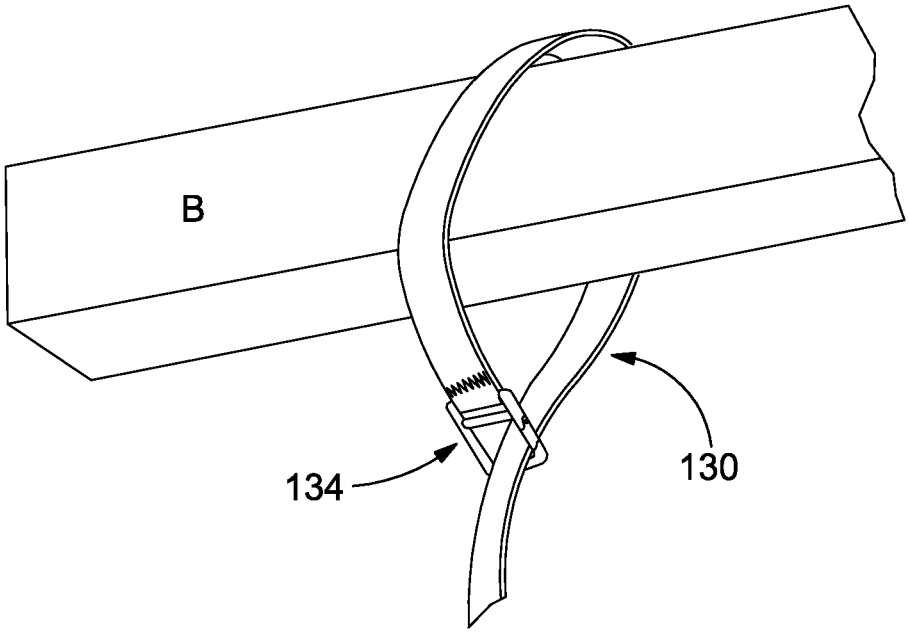
FIG. 24 shows a perspective view of a strap being located about a beam.
Figure 25:
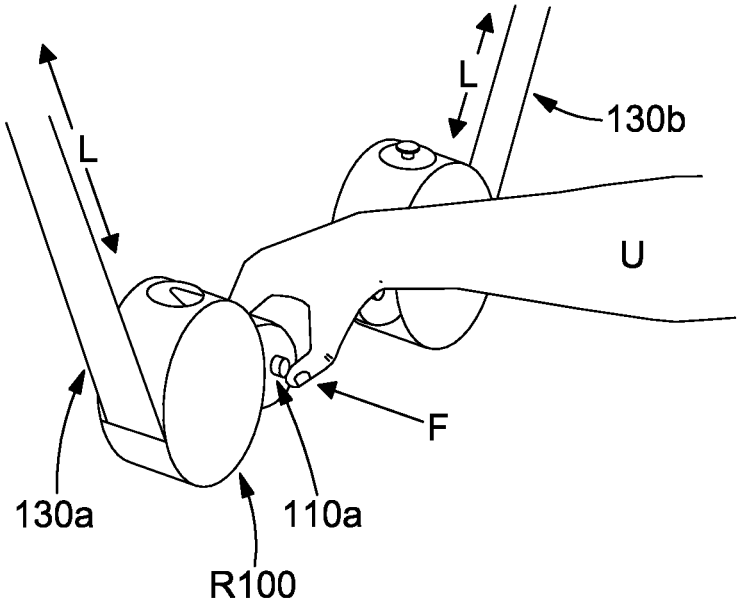
FIG. 25 shows a perspective view of a user preparing to adjust the length of straps used in the device.
Figure 29:
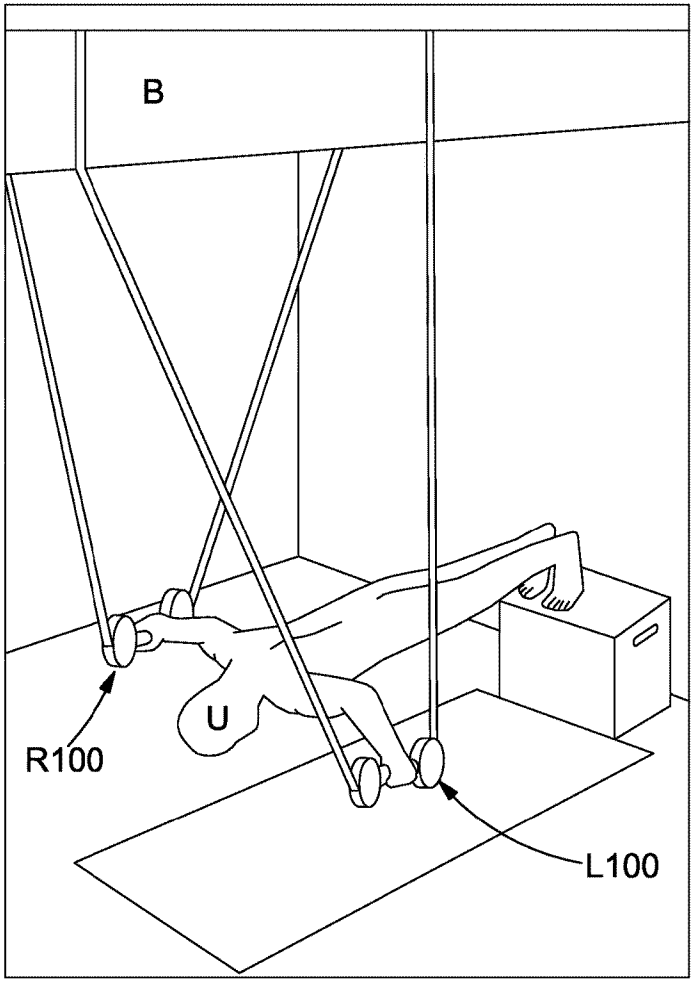
FIGS. 28-34 show the exercise device of the present invention being used in varying exercises.
Figure 28:
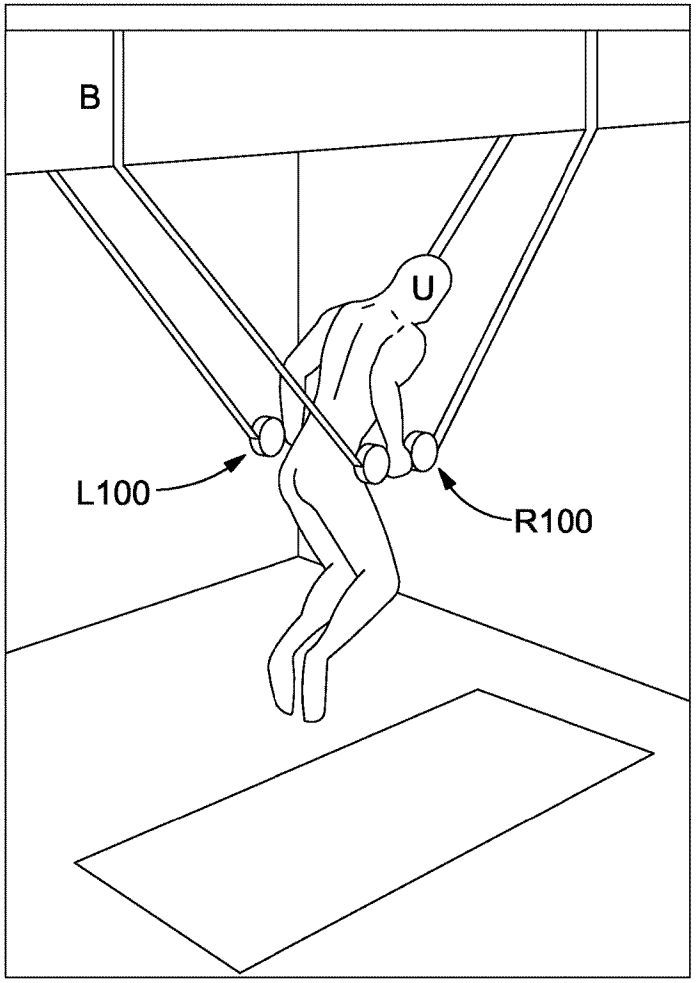
Figure 31:
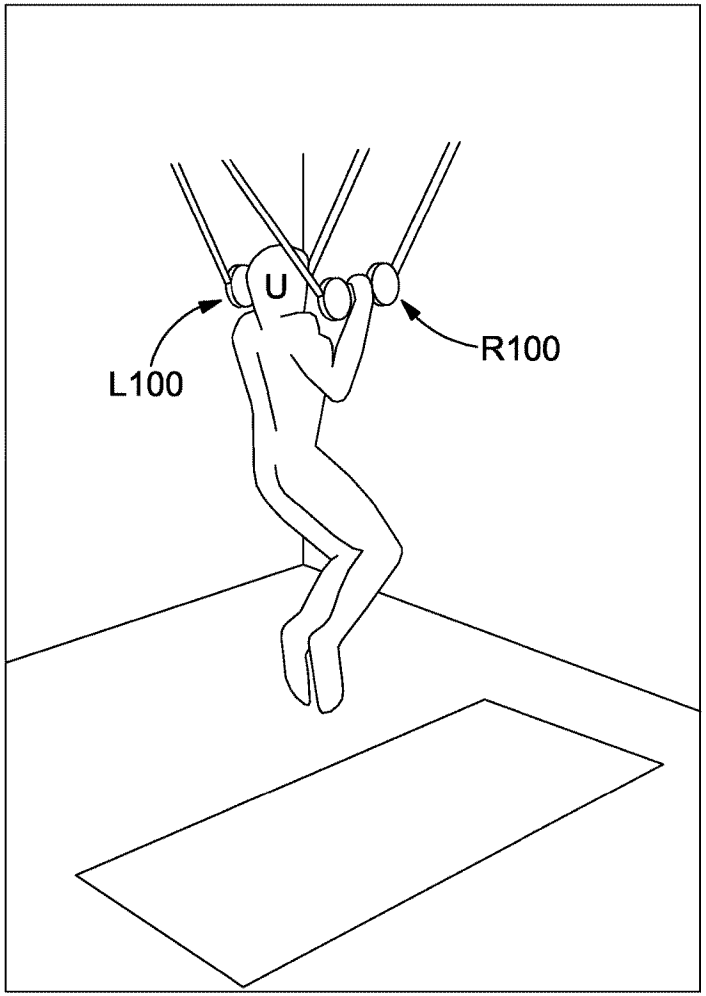

Initially, the strap 113 is fully retracted so that its entire length is wound on the reel 102 with just the hooped end and carabiner 134 exposed, as shown in FIGS. 2 and 20. So as to increase the strap length, the user U presses and holds the button 110 in the direction of arrow-headed line F on the same device 100 as the strap the user wishes to adjust, as shown in FIGS. 9 and 25. Whilst depressing the button 110 with one hand, the user's other hand is employed to extract the strap 130*a* or 130*b* by pulling on the strap with sufficient force to overcome the tension of the spiral springs 108, thereby increasing the length L (shown in FIGS. 9 and 26). When sufficient length of strap 130 has been extracted, the button 110 is released and the strap 130 is secured to a suitable anchor point using the carabiner 134. Such a suitable fixing point may be a beam B, as shown in FIG. 24, or other suitable attachment points such as hooks, frames, trees, or anything that has sufficient strength to support a user's weight. With four anchor points, as shown in FIGS. 28, 29 and 31, the straps may be secured in many different configurations including individually or in pairs, or at a single point. Because the length of each strap 130 may be adjusted independently, it is not essential for the anchor points to be level or in line with each other. Any unevenness in the anchor points may be corrected through strap adjustment so that the devices 100 hang at the same level. Thus, once the strap 130 has been secured on an anchor point, further adjustment of the strap is achieved by pressing and holding the button 110 and pulling the handle away from the anchor point to vary the length L.

So as to retract the strap 130 and wind it back on the reel 102, the button 110 is depressed and held in the direction of arrow-headed line F, whereupon the strap is retracted by the spiral spring 108 (see FIG. 26). The user controls the amount of retraction by releasing or applying load from the handles while the button 110 is depressed. Such action relieves tension in the strap 130 and the stored energy in the spiral spring 108 rotates the reel 102 so as to retract the strap 130.

Thus, when the button 110 is released coil spring 114 returns the shaft 112 back to the locked position and the reel 103 is locked. The lever arm 116 connects the two locking shafts 112*a*, 112*b* of each handle together through the central pin 117 so that when one button 110*a*, 110*b* is pressed, both locking shafts 112*a*, 112*b* slide into the unlocked position simultaneously, and when the button 110*a*, 110*b* is released both the locking shafts 112*a*, 112*b* simultaneously return to the locked position. Therefore, both reels 102*a*, 102*b* on a given device 100 are unlocked and locked simultaneously by pressing or releasing one of the buttons 110*a*, 110*b*. When unlocked, both reels are free to spin independently of each other in either direction at a speed controlled by a user. The elongated holes 111*a*, 111*b* toward the ends of the arm 116 permit sliding movement of the pivot pins 115*a*, 115*b* so as to allow arcuate movement of lever arm 116.

Simultaneous strap 130 adjustment may be achieved when both straps 130*a*, 130*b*, on a given device, are secured to suitable anchor points. The user may pull or push the handle away from or towards the anchor point whilst holding down the button 110 to achieve the desired strap length L, as shown in FIGS. 25 and 26. It will, therefore, be understood that the straps 130 are independent from one another so that they can be adjusted at different rates and to different lengths.

In use, many different exercises may be performed, as will now be described with reference to FIGS. 28 to 34.

Referring to FIG. 28, the strap 130 is located over the beam B by clipping the strap back on itself with the carabiner 134 to create a loop, as shown in FIG. 24, which will self-tighten when the strap 130 is pulled. The FIG. 28 shows the device straps forming a V-formation and is to be contrasted with the prior art of FIG. 1.

It will, therefore, be seen that by providing two straps per handle enables each handle to be suspended in a V-formation providing adequate clearance for the user's arms and shoulders, so exercises may be performed without obstruction or chafing. Thus, when performing a triceps dip, as shown in FIG. 28, the straps do not contact with any part of a user's body.

The present invention provides the following advantages:

a) By using up to four anchor points, so the problem of swinging and twisting is significantly reduced when a user is fully suspended and increases the number of configurations that may be employed.

b) By using buttons on the handles for adjustment of the straps, so adjustment, once suspended, can be achieved by a single hand and there is no requirement to let go of the handles and the flow of a workout is not interrupted.

c) By virtue of the straps wound on reels inside the device, so tidy storage is facilitated and tangling of the straps is prevented.

d) In performing exercises, only the required length of strap is unwound with no loose ends, whereby excess strap is contained in wound form on the reel.

e) The strap lengths may be adjusted from minimum to maximum enabling a wide range of configurations and exercises, and it will be readily understood that the minimum length achievable is many times shorter than the maximum length so as to permit a wider range of configurations and exercises to be performed than is possible with prior art devices.

f) With reference to FIGS. 33 and 34, the device may be used for ground exercises, such as push-ups and muscle against muscle exercises, to be described with reference to FIG. 33.

Figure 30:
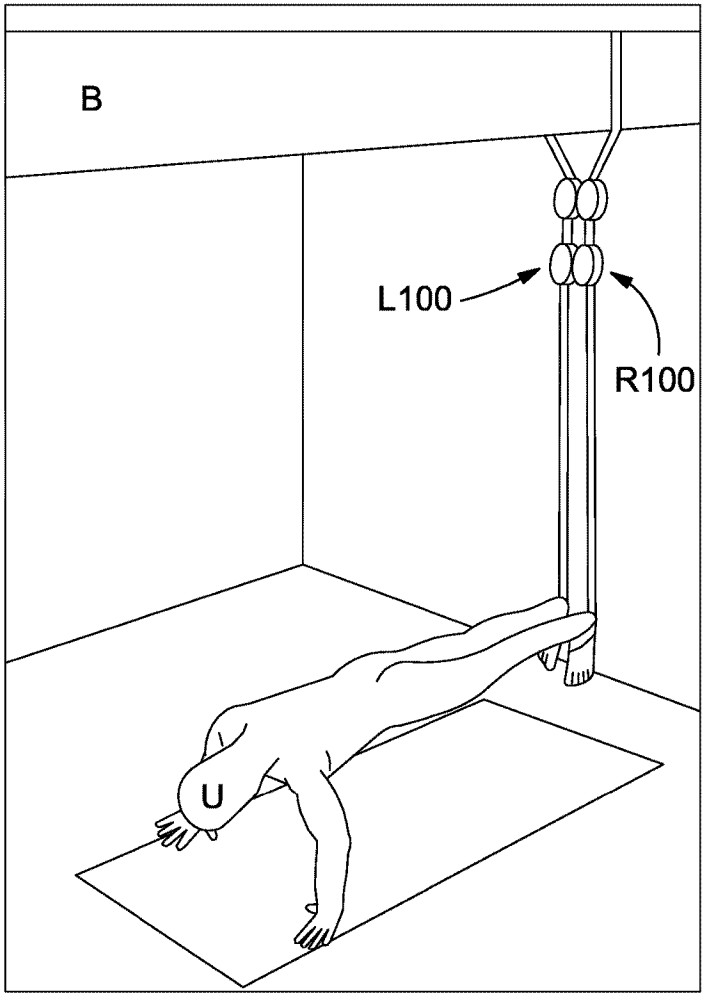
Figure 35:
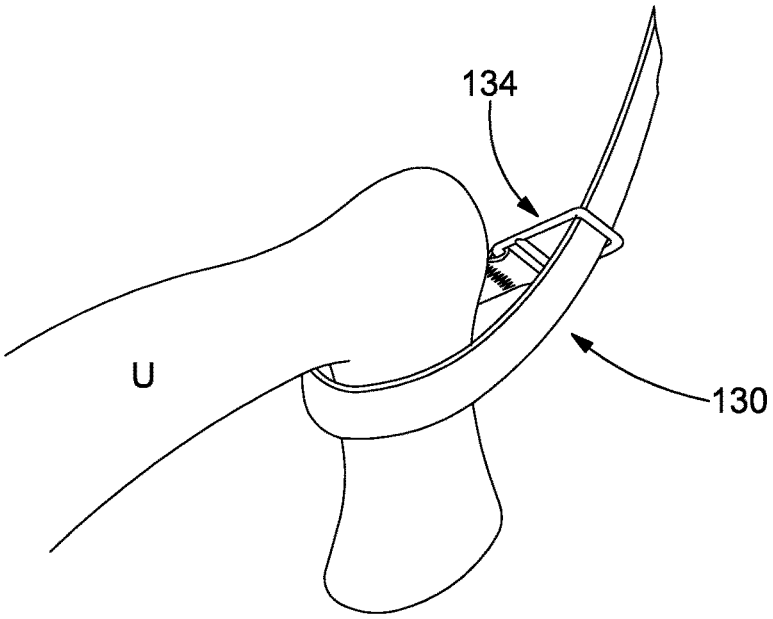
FIG. 35 shows a user securing their foot with a strap.

FIG. 30 shows a user in a push-up position with legs suspended by a pair of interconnected handles L100, R100. Thus, the straps 130 are in parallel formation looped around a user's foot, as shown in detail in FIG. 35. From this position, a user may perform a variety of abdominal exercises by contracting the abdominal muscles and pulling the legs or knees towards the body.

FIG. 31 shows a user performing pull-ups by shortening the straps 130 so that the handles R100 hang just below the beam B.

Figure 32:
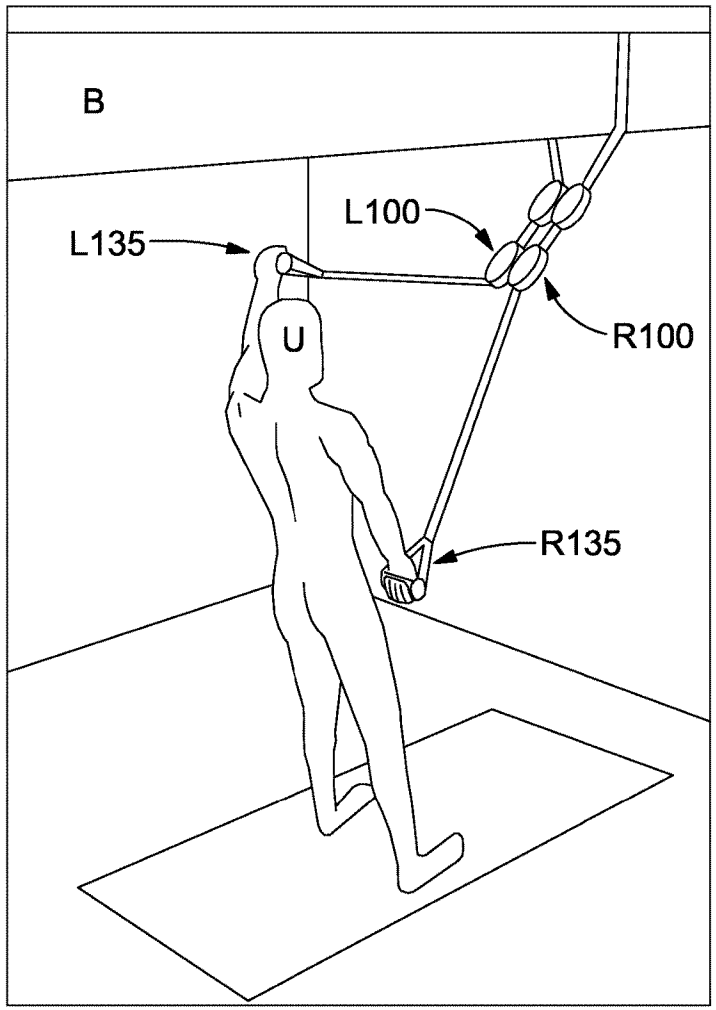

FIG. 32 shows two similar devices L100 and R100 connected together and auxiliary handles L135 and R135 attached to the straps 130, shown in greater detail in FIG. 27, creating a single strap per device configuration.

Figure 33:
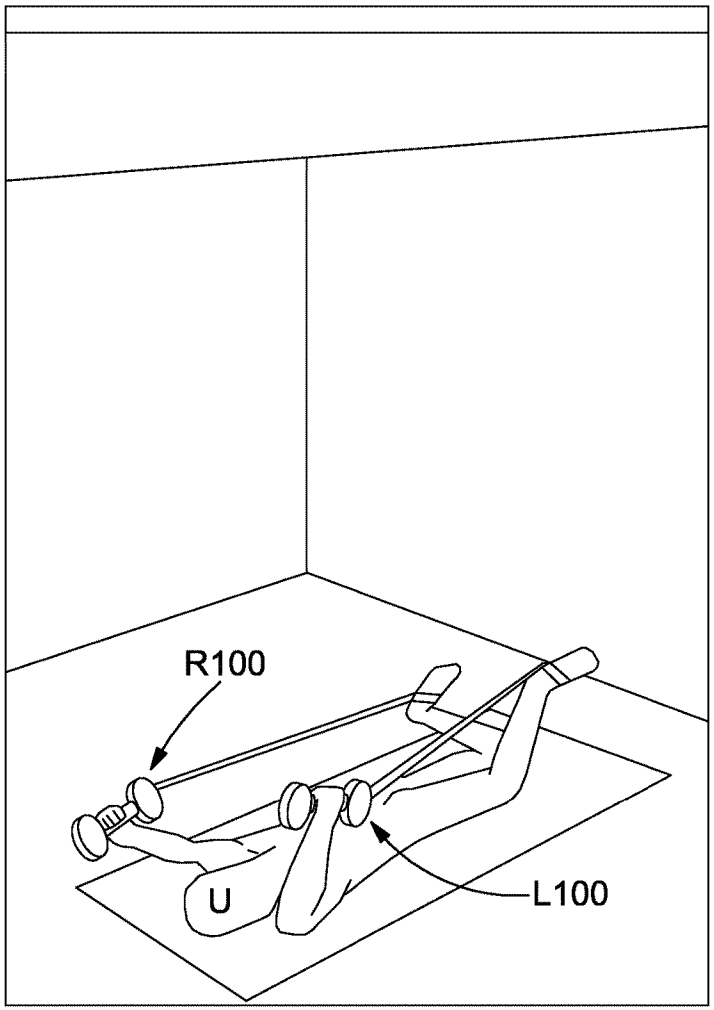

FIG. 33 illustrates the device in a muscle against muscle exercise, with the anchor point being a user's foot and the leg muscles providing the resistance whilst the arm muscles work in opposition. Thus, in this example, triceps work against quadriceps. This is an example of a non-suspended exercise and the quadriceps provide the resistance against which the triceps work, and the user may apply as much or as little resistance as they wish through the entire range of motion, with the leg muscles applying unmatchable force against the arm muscles. Near zero to maximum overload resistance can be achieved.

Figure 34:
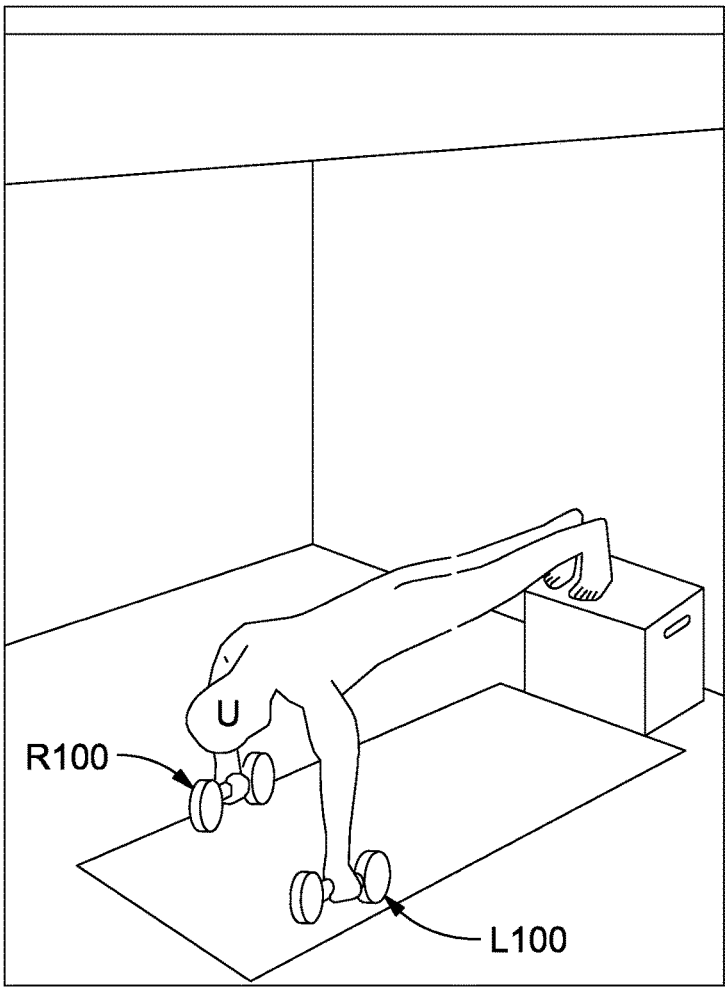

FIG. 34 shows a user performing a push-up exercise with the device handles L100, R100 acting as push up bars, with the user's feet 127 being in-ground engagement via an optional box.

The devices may also be used like dumbbells for warming up muscles and aerobic workouts.

Although each exercise device has been described as having a pair of sprockets 106*a* and 106*b*, in each drum-shaped end 150*a*, 150*b*, with each sprocket having an associated spiral spring 108*a*, 108*b*, it is envisaged that a simpler and less expensive device may be constructed with a single sprocket 106*a* in drum-shaped end 150*a* and a single sprocket 106*b* in drum-shaped end 150*b*, and also with a single associated spiral spring 108*a* and 108*b* in respective drum-shaped ends 150*a* and 150*b*.

In the further embodiment that is simpler and less expensive to construct, reference will now be made to FIGS. 36-45, having only one sprocket 406*a*, 406*b* on a respective axle and only one spring 408*a*, 408*b* for each respective sprocket.

Referring to FIGS. 36-38 and 42-45, the straps 130*a*, 130*b* (generically shown as reference 130 in FIG. 45) are wound around a portion of the periphery of a reel 403 that has an axial longitudinal slot into which distal ends of each strap 130*a*, 130*b* remote from carabiners 134*a*, 134*b* are overlapped around a reel bolt 404*a*, 404*b* (generically shown as 404 in FIG. 45) acting as an axle, the overlapping ends of the straps around the reel bolt being secured together by, for example, stitching, gluing or riveting.

Figure 36:
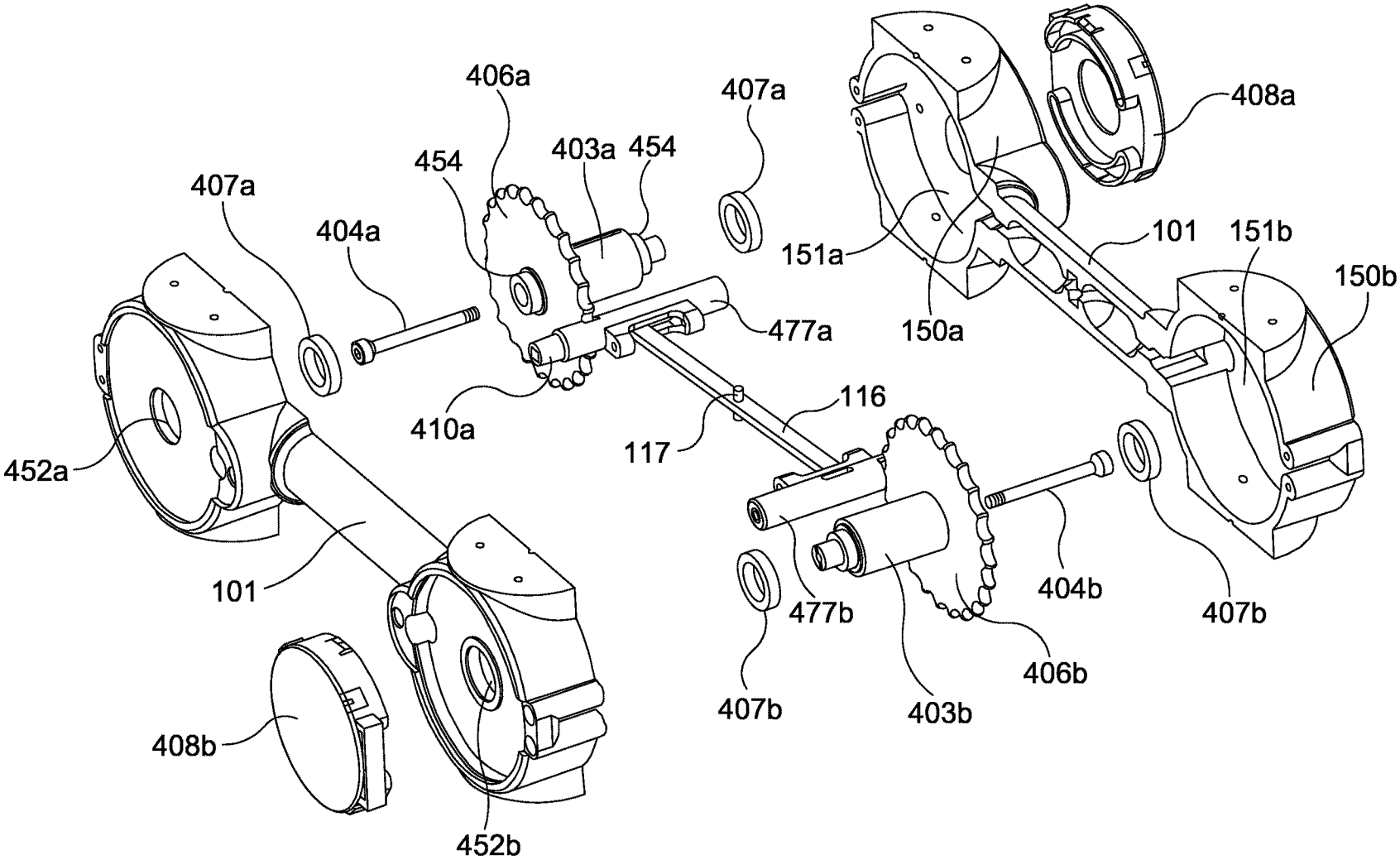
FIG. 36 shows an exploded perspective view of an exercise device in accordance with a further embodiment of this invention.
Figure 37:
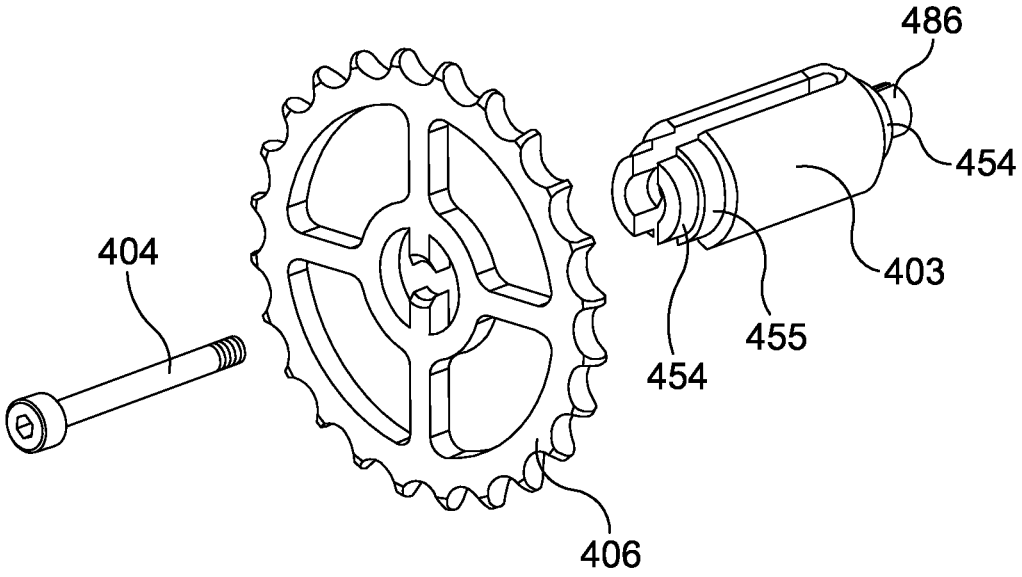
FIG. 37 shows an exploded perspective view of a sprocket and reel used in the exercise device of the further embodiment of this invention.
Figure 38:
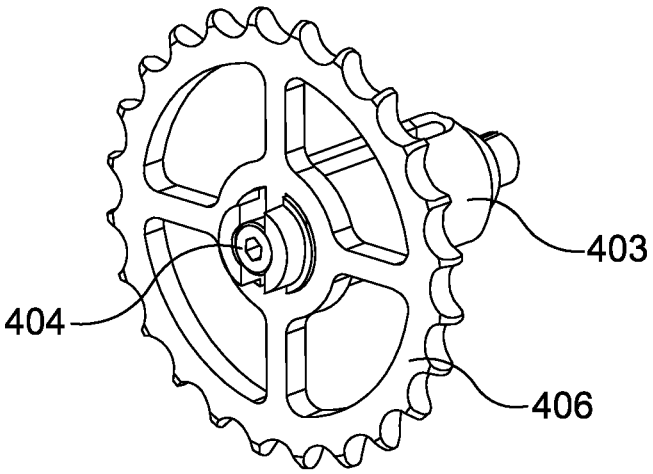
FIG. 38 shows the assembled sprocket and reel of FIG. 37.
Figure 41:
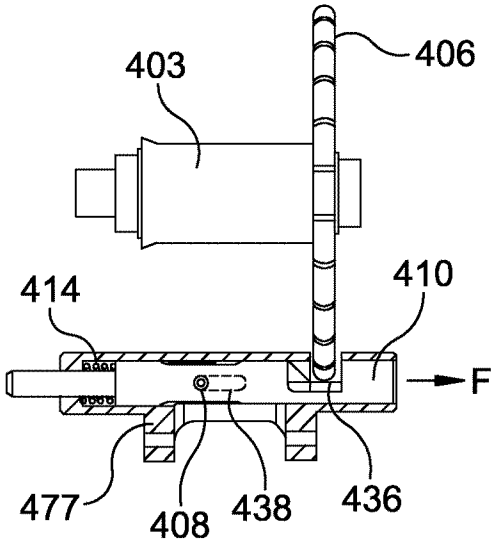
FIG. 41 shows a longitudinal side view along double arrow headed lines XL-XL of FIG. 39 in another operational position.

The reel bolt 404 also axially secures a toothed sprocket 406 to the reel 403. As shown in FIG. 36, opposing ends 454 of the reel 403*a*, 403*b* are mounted in annular ball race bearings 407*a*, 407*b* respectively, the bearings being fixedly secured into an axial hole 452*a*, 452*b* in each side and each end of the split casing 101.

The sprocket 406 is mounted on a collar 455 of the reel bolt 404 and has diametrically opposed keys which locate within mating diametric longitudinally extending slots within the reel 403. The reel 403 has a spigot 486 that extends through the annular plate 151*a*, 151*b* into a spiral spring unit 408*a*, 408*b*, whereby the reel 403 and, hence, sprocket 406, are rotatable against the bias of a spiral spring within the spring unit 408*a*, 408*b*.

As shown in the FIGS. 36 and 39-44, the sprocket 406*a*, 406*b* is rotatable in dependence upon the location of a locking mechanism which comprises the sprocket wheel and a button 410 that is a spring biased manually operable shaft being axially slidable within a barrel 477 against the pressure of a compression coil spring 414. The button 410 has a cutaway portion 436 wider than the width of the sprocket 406, and a diametric pin hole for locating a pin 408 that extends through a diametric slot 438 in the barrel 477, the pin 408 and slot 438 preventing the button 410 from rotation. A remote end of the button 410 is reduced in diameter to accept thereabout the inside diameter of the coil spring 414 so that the coil spring is restrained between an abutment inside the barrel 477 at one end thereof and a shoulder on the button 410. The barrel 477 has a notch 439 which is slightly wider than the width of the sprocket 406.

Figure 40:
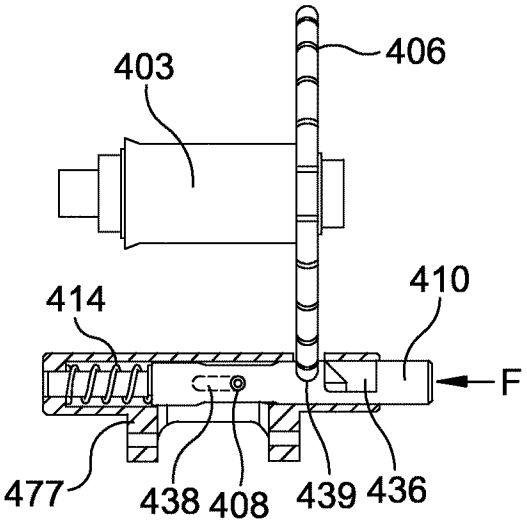
FIG. 40 shows a longitudinal cross-section along double arrow headed lines XL-XL of FIG. 39 in one operational position.
Figure 39:
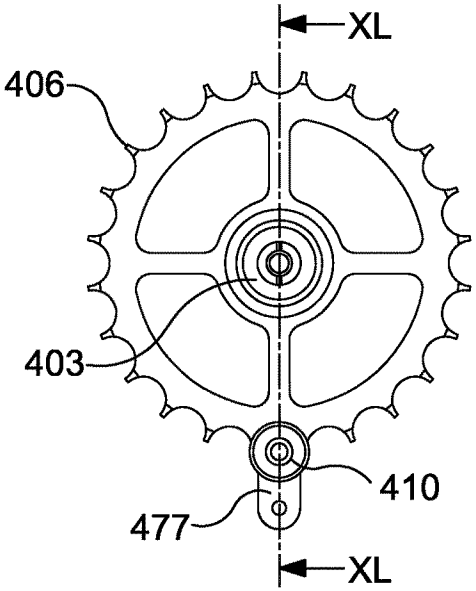
FIG. 39 shows a view of a reel and locking mechanism of the exercise device in the further embodiment.
Figure 42:
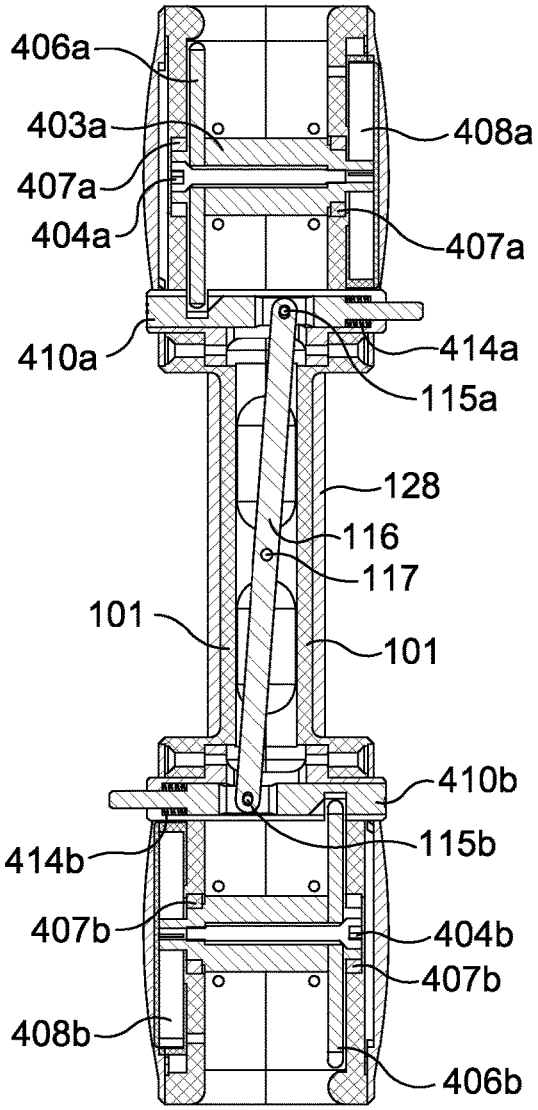
FIG. 42 shows a longitudinal cross-section of the exercise device in accordance with the further embodiment with the strap locking mechanism in an unlocked position.
Figure 43:
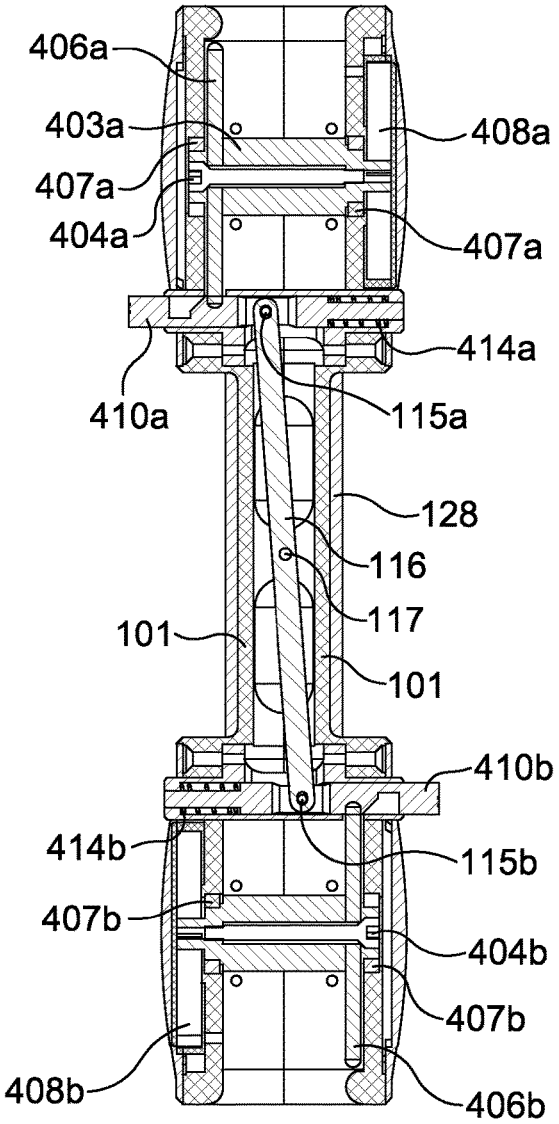
FIG. 43 shows a longitudinal cross-section of the exercise device in accordance with the further embodiment with the strap locking mechanism in a locked position.
Figure 44:
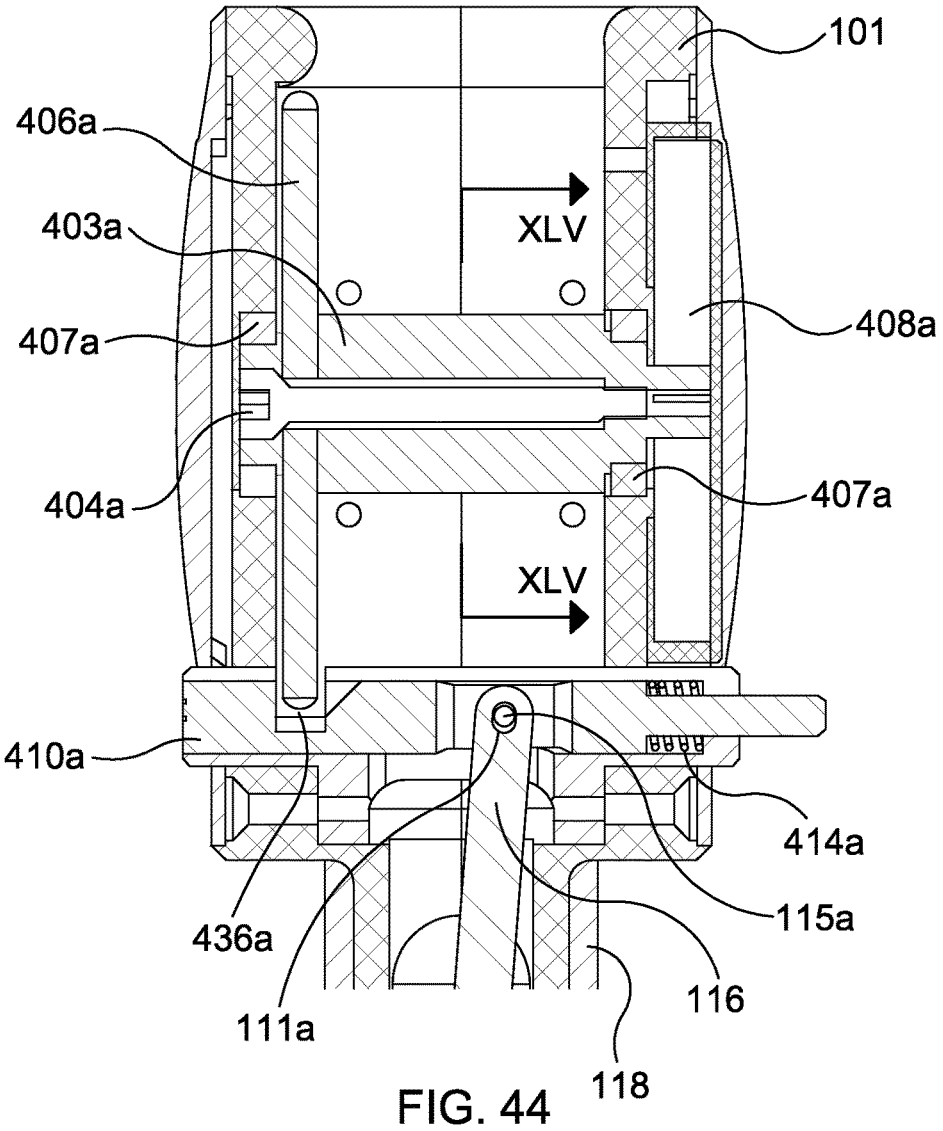
FIG. 44 shows in detail the locking mechanism of the exercise device of the further embodiment in an unlocked position.
Figure 45:
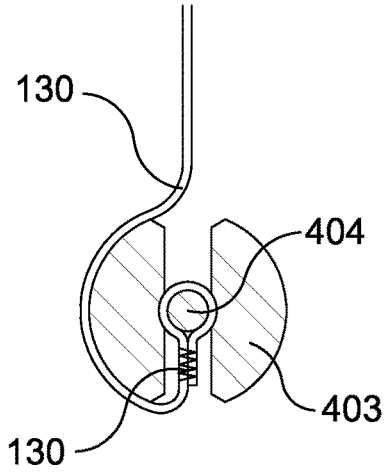
FIG. 45 shows a cross-section along double arrow headed lines XLV-XLV of FIG. 44.

In the operative position shown in FIGS. 40 and 43, the button 410 is moved outwardly from the casing 101 by the coil spring 414 and the extent of movement is restricted by the pin 408 and slot 438. In this position, the button 410 locates in the root between adjacent teeth of the sprocket so as to lock the sprocket from rotating. Thus, force is exerted by the coil spring 414 in the direction of arrow headed line F, shown in FIG. 41. When the button 410 is manually pressed in the direction of arrow headed line F in FIG. 40, so the coil spring 414 is compressed and the button 410 is moved axially longitudinally until it is prevented from further axial translation by the pin 408 abutting an end of the slot 438 and the teeth of the sprocket are free to rotate within the cutaway portion 436 in the button 410. This position is also shown in FIGS. 42 and 44.

Thus, the reel 403 is now able to rotate against the spring bias provided by the spiral spring unit 408 and, when rotated, the straps 130*a*, 130*b* are wound, or unwound.

Thus, the desired length of the straps 130*a*, 130*b* is achieved by holding the button 410 against the bias of the spring 414 to unlock the reel 403 by moving the cutaway portion 436 into registration with the sprocket 406. As long as the button 410 is pushed inwardly of the casing 101, so the relevant strap 130*a*, 130*b* can be adjusted to be longer by pulling away from the casing and overcoming the spring bias of the spiral spring unit 408. When at the desired length (and it will be realised that the length of the straps 130*a*, 130*b* are adjusted independently of one another), the button 410 is released to lock the reel 403 and the straps 130*a*, 130*b* are thereby locked at the length required by a user. So as to shorten the straps, button 410 is pressed and the spiral spring unit 408 recoils the straps 113 to wind them onto the reel 403.

Thus, it will now be understood, the further embodiment shown in FIGS. 36-45 has a reduced number of parts and is simpler and more economical to produce.

I claim:

1. An exercise device including a pair of axially spaced rotatable reels having axes in spaced apart planes, spring means arranged to bias each said reel in a direction of rotation, each said reel having associated therewith an inelastic strap, and selectably releaseable locking means arranged to release and lock said reels from rotation, wherein each said reel is arranged to extend a respective one of said straps against the bias of said spring means or to rewind said strap about a respective reel under the influence of said spring means, and also wherein the reels and locking means are located within a casing, said casing being generally dumbbell-shaped with the reels being longitudinally axially spaced apart and each located in a drum-shaped end, and said drum-shaped ends being interconnected by a member forming a handle, said casing being provided in two longitudinally conjoined halves, the reels and locking means being located between the two halves and the spring means being located in an outer portion of each drum-shaped end.

2. The exercise device as claimed in claim 1, wherein each said reel comprises a pair of axially spaced sprockets and said strap is arranged to be wound around an axle spacing said sprockets, and one distal end of said respective strap is arranged to be attached to said axle.

3. The exercise device as claimed in claim 2, wherein said locking means includes a pivoted arm having at opposed ends thereof a transverse member arranged to inter-engage between teeth of the axially spaced sprockets.

4. The exercise device as claimed in claim 3, wherein the transverse member is configured to be manually movable by a user to pivot the arm so that the transverse member is movable to simultaneously lock or unlock the axially spaced sprockets from rotation of at least one said reel.

5. The exercise device as claimed in claim 4, wherein the arm is spring biased to lock the sprockets from rotation and said transverse member is movable by the user against the spring bias to enable rotation of the sprockets.

6. The exercise device as claimed in claim 2, wherein an end of the respective strap remote from said distal end attached to the axle is arranged into a loop to secure a carabiner.

7. The exercise device as claimed in claim 6, wherein a plurality of longitudinally spaced hoops are provided on the strap adjacent to the carabiner to facilitate the attachment of a carabiner of another strap.

8. The exercise device as claimed in claim 2, wherein said spring means is at least one spiral spring connected to said axle, whereby said sprockets are rotatable with or against the bias of said at least one spiral spring.

9. The exercise device as claimed in claim 2, wherein the spring means is a spiral spring, the spiral spring is provided at each opposing end of said axle.

10. The exercise device as claimed in claim 1, wherein each said reel comprises a single sprocket toward one end of an axle about which said associated strap is wound.

11. The exercise device as claimed in claim 10, wherein at least one of the reels has a longitudinally extending diametric slot therein and the axle, wherein an associated one of the straps is inserted through the slot and secured in overlapping manner about the axle.

12. The exercise device as claimed in claim 11, wherein the locking means comprises the sprocket attached to one reel of the pair of reels and a spring biased manually operable shaft slideably mounted in a barrel, said shaft and barrel each having a cut-out therein disposed along a longitudinal axis thereof, said cut-outs having a width greater than a width of the sprocket, whereby the sprocket is arranged to locate through the cut-out in the barrel, and the shaft has at least a portion thereof having a full diameter sufficient to locate between teeth of the sprocket, and translational motion of the shaft within the barrel permits the sprocket wheel to rotate within the cut-outs of the barrel and shaft, or to have rotation thereof arrested by said full diameter of the shaft engaging between adjacent teeth of the sprocket.

13. The exercise device as claimed in claim 12, wherein the shaft is prevented from rotation within the barrel by a pin located transverse to the longitudinal axis of the shaft, which said pin engages within a diametric slot in the barrel.

14. The exercise device as claimed in claim 10, wherein a spiral spring is provided at only one end of said axle.

15. The exercise device as claimed in claim 1, wherein each drum-shaped end of the casing has a circumferential portion on which is provided a planar surface and on one said planar surface of one drum-shaped end is provided a male connector and on the other said planar surface of the other drum-shaped end is provided a female connector, whereby two exercise devices are configured to be secured together by interlocking respective male and female connectors so as to create one double handle or two single handles.

16. The exercise device as claimed in claim 15, wherein mounted on an opposite side of said drum-shaped end to respective male and female connectors is a rubber foot for engagement with the ground.

17. The exercise device as claimed in claim 1, wherein said spring means is provided for each said reel.

18. The exercise device as claimed in claim 1, wherein the locking means is arranged to simultaneously lock or unlock both said reels from rotation.

19. The exercise device as claimed in claim 1, wherein each said reel, when unlocked by said locking means, is arranged to rotate independently of the other said reel so that the length of strap deployed from each said reel is selectably variable.

20. The exercise device as claimed in claim 1, wherein each said reel, when released by the locking means, is arranged to rotate independently of the other reel in either direction at a speed controlled by a user.

21. An exercise device including a pair of axially spaced rotatable reels having axes in spaced apart planes, spring means arranged to bias each said reel in a direction of rotation, each said reel having associated therewith an inelastic strap, and selectably releaseable locking means arranged to release and lock said reels from rotation, wherein each said reel is arranged to extend a respective one of said straps against the bias of said spring means or to rewind said strap about a respective reel under the influence of said spring means, each said reel comprising a single sprocket wheel toward one end of an axle about which said strap is wound and said reel has a longitudinally extending diametric slot therein and the axle, said associated strap being inserted through the slot and secured in overlapping manner about the axle, and also wherein the locking means comprises the sprocket wheel attached to the reel and a spring biased manually operable shaft slideably mounted in a barrel, said shaft and barrel each having a cut-out therein disposed along a longitudinal axis thereof, said cut-outs having a width greater than a width of the sprocket wheel, whereby the sprocket wheel is arranged to locate through the cut-out in the barrel, and the shaft has at least a portion thereof having a full diameter sufficient to locate between teeth of the sprocket wheel, and translational motion of the shaft within the barrel permits the sprocket wheel to rotate within the cut-outs of the barrel and shaft, or to have rotation thereof arrested by said full diameter of the shaft engaging between adjacent teeth of the sprocket wheel.

22. The exercise device as claimed in claim 21, wherein the shaft is prevented from rotation within the barrel by a pin located transverse to the longitudinal axis of the shaft, which said pin engages within a diametric slot in the barrel.

* * * * *